US005745969A

United States Patent [19]

Yamada et al.

[11] Patent Number: 5,745,969

[45] Date of Patent: May 5, 1998

[54] METHOD AND APPARATUS FOR REPAIRING A COKE OVEN

[75] Inventors: Shigeru Yamada; Hiroyuki Shiraishi; Terutsune Nishio; Hideaki Morimoto, all of Ehime; Keiji Matsuda, Chiba; Tetsuro Uchida, Chiba; Tamotsu Takahashi, Chiba; Tsutomu Matsuno; Keizi Kamegawa, both of Tokyo; Makoto Numazawa, Osaka; Ryuzo Moritani, Osaka; Hidekuni Ito, Osaka; Toshio Kondo, Wakayama; Hideki Ohhira; Shunji Horinouchi, both of Hyogo, all of Japan

[73] Assignees: Sumitomo Heavy Industries, Ltd., Tokyo; Kawasaki Steel Corporation, Kobe; NKK Corporation, Tokyo; Sumitomo Metal Industries, Ltd., Osaka; Kansai Netukagaku Kabushiki Kaisha, Amagasaki, all of Japan

[21] Appl. No.: 492,025

[22] PCT Filed: Oct. 28, 1994

[86] PCT No.: PCT/JP94/01821

§ 371 Date: Aug. 31, 1995

§ 102(e) Date: Aug. 31, 1995

[87] PCT Pub. No.: WO95/11950

PCT Pub. Date: May 4, 1995

[30] Foreign Application Priority Data

| | | | |
|---|---|---|---|
| Oct. 29, 1993 | [JP] | Japan | 5-293990 |
| Oct. 29, 1993 | [JP] | Japan | 5-293991 |
| Oct. 29, 1993 | [JP] | Japan | 5-293992 |

[51] Int. Cl.[6] ..... B23P 6/00

[52] U.S. Cl. ..... 29/402.18; 29/407.05; 264/30

[58] Field of Search ..... 264/30; 239/71–74; 266/281; 29/407.05, 402.18, 527.2, 530

[56] References Cited

U.S. PATENT DOCUMENTS

| | | | |
|---|---|---|---|
| 4,577,385 | 3/1986 | Omae et al. | 29/402.18 |
| 5,378,493 | 1/1995 | Zivkovic | 264/30 |

FOREIGN PATENT DOCUMENTS

| | | |
|---|---|---|
| 52-36703 | 3/1977 | Japan . |
| 58-206681 | 12/1983 | Japan . |
| 60-17689 | 1/1985 | Japan . |
| 2-99592 | 4/1990 | Japan . |
| 4-32690 | 2/1992 | Japan . |

*Primary Examiner*—David P. Bryant

*Attorney, Agent, or Firm*—Sughrue, Mion, Zinn, Macpeak & Seas, PLLC

[57] ABSTRACT

A repairing method using a lance for repairing an oven wall surface of a coke oven comprises the steps of arranging a distance sensor at a top end of the lance, quantitatively measuring a depth of a worn or a damaged area by the distance sensor, and blowing a repairing material from a repairing nozzle to the worn area in accordance with a measurement result to thereby repair the worn area. The lance used in this repairing method has a multistage structure having a polygonal cross section and is extendable. With this structure, the oven wall surface can be scanned in a linear fashion or along a plane. If the top end of the lance is movable in accordance with a basic motion pattern and/or a travelling pattern, it is possible to readily repair a repair range having a complicated shape.

36 Claims, 22 Drawing Sheets

FIG. 22 (a)
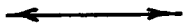
FIG. 22 (b)
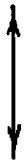
FIG. 22 (c)
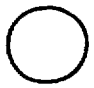
FIG. 22 (d)

(a)

(b)

(c)

(d)

(e)

(f)

METHOD AND APPARATUS FOR REPAIRING A COKE OVEN

TECHNICAL FIELD

This invention relates to a method and an apparatus for repairing a damaged area of an oven wall which partitions a coke oven chamber (namely, a carbonization chamber) and a combustion chamber in a coke oven of a chamber oven type.

BACKGROUND ART

A coke oven of a chamber oven type comprises regenerator chambers located at a lower portion of a furnace body. On the regenerator chambers, coke oven chambers and combustion chambers are alternately arranged. Fuel gas and air are preheated (in case of rich gas, air alone is preheated) in the regenerator chambers, burnt, then subjected to heat recovery in the adjacent regenerator chambers, and discharged through flue ducts. Coal charge in each coke oven chamber is indirectly heated through oven walls from the combustion chambers located at both sides thereof and is thereby subjected to dry distillation to be transformed into coke. The coke oven of a chamber oven type is constructed mainly by silica bricks and clay bricks and partly by heat insulating bricks and common bricks.

When the coke oven of a chamber oven type is used for a long period of time, damages are inevitably caused to occur on oven walls due to various factors such as external mechanical force, thermal stress, and moisture in coal charge. In particular, the oven walls in the coke oven chambers are readily subjected to damages such as crack of joint, crevasse, flaking of bricks because those actions based on the above-mentioned various factors are concentrated thereto. In presence of such damages, resultant gas produced in the coke oven chamber may flow into the combustion chambers. This results in environmental pollution by black smoke produced in incomplete combustion and in deterioration of productivity due to local decrease in temperature of the combustion chambers. In view of the above, it has been a practice to spray mortar onto a damaged area as a repairing material. In case of a serious damage, the bricks must be exchanged at a high repairing cost.

It has been said that the coke oven of a chamber oven type has a lifetime between 20 and 25 years. Recently, an extended lifetime between 30 and 35 years is expected by an adaptive repair work enabled by an improved accuracy in diagnosing the damaged area of the oven wall and an improved repairing method.

On the other hand, replacement of the coke oven requires a large investment of at least several tens of billions for each coke oven battery. This imposes a heavy pressure upon a financial environment of a company. It is assumed that the existing coke ovens in this country have a lifetime of 35 years. In this event, most of those ovens must be replaced around 2000 A.D. This implies a problem of shortage of silica bricks and oven constructors.

Taking the above into consideration, it is an urgent demand of the coke manufacturers to create a universal and effective repairing technique which prolongs the lifetime of the coke ovens of a chamber oven type up to 40 through 45 years or more.

As a method of repairing an oven wall of a coke oven, various conventional methods are known as will presently be described. As disclosed in JP-A No. 206681/1983, a first repairing method uses a lance unit provided at its top end with an optical system including an optical fiber and comprises the steps of inserting the lance unit into a coke oven chamber or a combustion chamber of a coke oven, scanning an oven wall in relation to an absolute position on the oven wall to obtain an image of the oven wall, observing, via the image thus obtained, the oven wall in the coke oven chamber or the combustion chamber to detect a damaged area, and memorizing image data of the oven wall in a memory of a computer together with the absolute position on the oven wall.

As disclosed in JP-B2 No. 17277/1993, a second repairing method uses a heat-resistant protector tube provided with an optical system including an optical fiber or a television camera, and comprises the steps of inserting the protector tube into a coke oven chamber or a combustion chamber, detecting from the outside of the oven a damaged area of an oven wall in the coke oven chamber or the combustion chamber, and spraying a repairing material onto the damaged area of the oven wall from a repairing material spraying nozzle arranged in the protector tube to thereby repair the damaged area.

As disclosed in JP-A No. 17689/1985, a third repairing method comprises the steps of adjusting a location of a flame spraying gun towards a damaged area of an oven wall by the use of a television camera and a monitoring unit, measuring a distance from the oven wall and the damaged area thereof to the flame spraying gun, and carrying out repair work with the distance controlled to be kept at a predetermined optimum distance.

On the other hand, as an oven wall repairing apparatus, various apparatuses are known as will presently be described. A first repairing apparatus is disclosed in JP-U No. 36703/1977. The first repairing apparatus comprises a water-cooled elongated cylindrical member containing supply pipes for combustible gas, oxygen, and refractory powder. The elongated cylindrical member has one end provided with a flame spraying burner removably attached thereto and the other end provided with a manipulation handle. The elongated cylindrical member is fitted to a support frame to be rollable and is mounted on a mobile carriage to be movable and swingable.

A second repairing apparatus is disclosed in JP-A No. 17689/1985 described in conjunction with the above-mentioned third repairing method. This repairing apparatus comprises a head portion to be inserted into an oven. The head portion comprises a cooling case containing a flame spraying gun for spraying a monolithic refractory onto a damaged area of an oven wall, a television camera for picking up an image of the damaged area of the oven wall, and a range finder for measuring a distance from the oven wall and the damaged area thereof to the flame spraying gun. The second repairing apparatus further comprises a monitoring unit for enabling the image picked up by the television camera to be observed at the outside of the oven. The head portion is moved along three axes with reference to a measurement value obtained by the range finder to control the distance from the oven wall and the damaged area thereof to the flame spraying gun so that the distance is coincident with an optimum distance.

As disclosed in JP-A No. 99592/1990, a third repairing apparatus comprises a water-cooled box removably attached to a top end of a boom. The box contains those components required in flame spraying, such as a flame spraying burner and a monitoring camera.

As disclosed in JP-A No. 99589/1990, a fourth repairing apparatus comprises a water-cooled box containing a monitoring camera and a flame spraying burner. This box is removably attached to an elongated beam. The elongated beam is attached to a carriage. The carriage has wheels running along a track on a work floor. It is possible to swing and upwardly and downwardly move a support frame for supporting the elongated beam and to freely select forward or backward movement of the carriage as well as an inclination angle of the elongated beam.

As disclosed in JP-A No. 32690/1992, a fifth repairing apparatus comprises a running carriage. On the running carriage, a base is mounted to be movable up and down and swingable. A guide rail is tiltably formed on the base. A lance holder is movable along the guide rail. A flame spraying lance is telescopically fitted in the lance holder. A camera for monitoring an oven wall is mounted on the lance holder.

According to the first and the second repairing methods described above, however, a wear condition of the oven wall is only visually detected and a wear amount, for example, a depression amount can not be quantitatively detected. In this connection, a sense of an operator is resorted to in determining a range to be repaired and the amount of the repairing material to be sprayed. In order to make the memory of the computer memorize all the image data obtained by the optical system, the memory capacity must be extremely large. In addition, the operator can not enter into the oven because the repair work is carried out before the inside of the oven is completely cooled down. Besides, the optical system is substantially useless during the repair work because of dust, smoke, and high-temperature flame produced by spraying the repairing material. In this situation, the sense of the operator is substantially exclusively relied upon to carry out the repair work. Furthermore, the lance unit used in examining and repairing the oven wall in the coke oven comprises a plurality of stages of lances in a telescopic arrangement. The lance at each stage comprises a cylindrical member having a circular section and is therefore difficult to drive a rotation thereof. Specifically, when the first-stage lance is rotated around an axis, slip is caused between contact surfaces of the first-stage lance and the second-stage lance. In this event, the rotation of the first-stage lance is not transmitted to the second-stage lance.

According to the third repairing method described above, the distance between the flame spraying gun and the damaged area of the oven wall is adjusted to an optimum value to thereby reduce a rebound loss of the spraying material. Thus, a deposit efficiency of the spraying material is improved. However, it is impossible to carry out optimum repair work in correspondence to the depth of the damaged area of the oven wall.

On the other hand, the above-mentioned first repairing apparatus requires the operator to manipulate the manipulation handle with his eyes watching the damaged area of the oven wall so as to repair the damaged area by the use of the flame spraying burner located at one end of the water-cooled elongated cylindrical member. As a consequence, the sense of the operator is resorted to in determining the range to be repaired and the amount of the repairing material to be sprayed.

With the above-mentioned second repairing apparatus, the distance between the damaged area of the oven wall and the flame spraying gun can be kept constant. However, no disclosure is made about quantitative detection of a damage condition of the damaged area of the oven wall and execution of the repair work adapted to the damage condition.

The third and the fourth repairing apparatuses described above require the operator to manipulate the boom or the elongated beam containing the flame spraying burner while monitoring the image of the oven wall as obtained by the monitoring camera. In this connection, the sense of the operator is resorted to in determining the range to be repaired and the amount of the repairing material to be sprayed.

Like the above-described fourth repairing apparatus, the above-mentioned fifth repairing apparatus requires the operator to manipulate the flame spraying lance while monitoring the image obtained by the monitoring camera. As a consequence, the sense of the operator is resorted to in determining the range to be repaired and the amount of the repairing material to be sprayed.

At any rate, according to the conventional repairing apparatuses and the conventional repairing methods, the damaged or the worn area is repaired in dependence upon a flat image of the surface of the oven wall. However, it is found out practically difficult to quantitatively detect the depth of the damaged or the worn area from such a flat image. Taking into account that the repair work is carried out in the coke oven at a high temperature and in a condition where visual observation is extremely difficult, it is even difficult to visually identify the damaged or the worn area from the flat image alone.

It is therefore an object of this invention to provide a repairing method and a repairing apparatus for repairing an oven wall of a coke oven, which remove the disadvantages in the conventional examining methods, repairing methods, and repairing apparatuses for an oven wall of a coke oven and which can quantitatively detect a wear condition and a wear amount of the oven wall.

It is an object of this invention to provide a repairing method and a repairing apparatus which are capable of repairing an oven wall even at a high temperature and in a severe condition.

DISCLOSURE OF THE INVENTION

In order to achieve the above-mentioned objects, the present inventors repeatedly executed various tests and accumulated their study. As a consequence, it has been found out that automatic repair is enabled by executing the following steps. At first, a distance sensor located at a top end of a lance measures a distance between the top end of the lance and an oven wall to obtain wear amount data of the oven wall. In this case, the top end of the lance having an injection nozzle for injecting a repairing material may be provided with an image pickup device such as a television camera or a fiber scope so that the oven wall is scanned by the image pickup device to identify a damaged or a worn area. In addition, from a driving amount of a lance driving system for driving the lance, a position coordinate of the damaged area of the oven wall is calculated with respect to the top end of the lance.

Next, with reference to the position coordinate of the damaged area of the oven wall and the wear amount data, a repair range as required is indicated and a predetermined repair pattern is selected. The lance driving system is controlled to move the top end of the lance and to spray the repairing material onto the damaged area so as to repair the damaged area.

Specifically, according to this invention, a method of repairing an oven wall of a coke oven by the use of a lance is characterized by the steps of mounting a distance sensor at a top end of the lance, measuring the depth of a worn or a damaged area in the oven wall by the distance sensor, and injecting a repairing material from a repairing nozzle mounted at the top end of the lance onto the worn area to thereby repair the worn area.

According to this invention, there is provided a method of repairing an oven wall of a coke oven by the use of a repairing apparatus which is capable of mechanically or electrically controlling a position of a repairing nozzle, the method comprising the steps of preliminarily setting, in a lance controlling section, basic motion patterns for the repairing nozzle and travelling patterns within a repair range, determining the repair range prior to start of repair work with reference to wear information of a worn or a damaged area, selecting a repair pattern comprising a combination of one of the basic motion patterns for the repairing nozzle and one of the travelling patterns, and controlling a travelling speed of the repairing nozzle and/or an amount of a repairing material to be injected so that the damaged area is automatically repaired.

According to this invention, there is also provided a method of repairing a coke oven by the use of a repairing apparatus which is capable of mechanically or electrically controlling a position of a repairing nozzle, the method comprising the steps of preliminarily setting, in a lance controlling section, basic motion patterns for the repairing nozzle and travelling patterns within a repair range, preparing a wear distribution chart with reference to wear information of a worn or a damaged area, determining the repair range with reference to the wear distribution chart, selecting a repair pattern comprising a combination of one of the basic motion patterns for the repairing nozzle and one of the travelling patterns, and controlling a travelling speed of the repairing nozzle and/or an amount of a repairing material to be injected so that the damaged area is automatically repaired.

According to this invention, there is also provided a method of repairing a coke oven by the use of a repairing apparatus which is capable of mechanically or electrically controlling a position of a repairing nozzle, the method comprising the steps of preliminarily setting, in a lance controlling section, basic motion patterns for the repairing nozzle and travelling patterns within a repair range, determining, prior to start of repair work, the repair range with reference to wear condition of a worn or a damaged area, setting a distance between a distance sensor and a normal brick surface around the worn area at the time instant of measurement of wear, selecting a repair pattern comprising a combination of one of the basic motion patterns for the repairing nozzle and one of the travelling patterns, controlling a travelling speed of the repairing nozzle and/or an amount of a repairing material to be injected, measuring a distance between the distance sensor and a repair surface varying from time to time, calculating a distance between a measurement position of the distance sensor at the time instant of measurement of a damage and a repair position of the distance sensor during the repair work, and monitoring that the repair surface varying from time to time exceeds a virtual normal brick surface in the worn area.

According to this invention, there is also provided a method of repairing a coke oven, comprising the steps of scanning an oven wall surface by the use of an image pickup device mounted at a top end of a lance having a repairing nozzle for injecting a repairing material, displaying an image on a monitor, measuring a distance between the top end of the lance and the oven wall surface by a distance sensor mounted at the top end of the lance to obtain wear amount data of the oven wall surface, calculating, from a driving amount of a lance driving mechanism for driving the lance, position coordinate data of a worn or a damaged area in the oven wall surface with respect to the top end of the lance, indicating a required repair range on the oven wall surface and selecting a repair pattern with reference to image information of the wall surface, the wear amount data, and the position coordinate data of the worn area, and repairing the worn area in the oven wall surface by spraying in accordance with the repair pattern as selected.

According to this invention, an apparatus for repairing a coke oven comprises a multistage telescopic lance unit provided at its top end with a repairing nozzle which is for injecting a repairing material and which is movable along a plane, a lance driving mechanism for driving the multistage telescopic lance unit, a distance sensor mounted at the top end of the multistage telescopic lance unit to be adjacent to the nozzle for measuring a distance from an oven wall surface, and a lance operating section for calculating wear amount data of the oven wall surface in response to a signal supplied from the distance sensor and for operating the lance unit with reference to the wear amount data and position coordinate data of a worn or a damaged area so that the nozzle is moved on the worn area in the oven wall surface.

According to this invention, an apparatus for repairing a coke oven by the use of a multistage telescopic lance unit comprises the multistage telescopic lance unit having an axis extendable in a predetermined direction and a lance driving system for driving the multistage telescopic lance unit, the multistage telescopic lance unit comprising a first-stage lance, second-stage through N-th-stage lances assembled in the first-stage lance to be extendable in an axial direction, and a fixed outer cylinder for fitting and accommodating the first-stage lance therein to thereby support the first-stage through the N-th-stage lances, the lance driving system comprising a lance extension driving mechanism formed between the fixed outer cylinder and the first-stage through the N-th-stage lances, and a tilting mechanism for tilting the fixed outer cylinder in a vertical plane.

BRIEF DESCRIPTION OF THE DRAWING

FIGS. 22(*a*)–22(*d*) show basic motion patterns for the injection nozzle of the repairing apparatus according to this invention.

MODE FOR EMBODYING THE INVENTION

Figure 1:
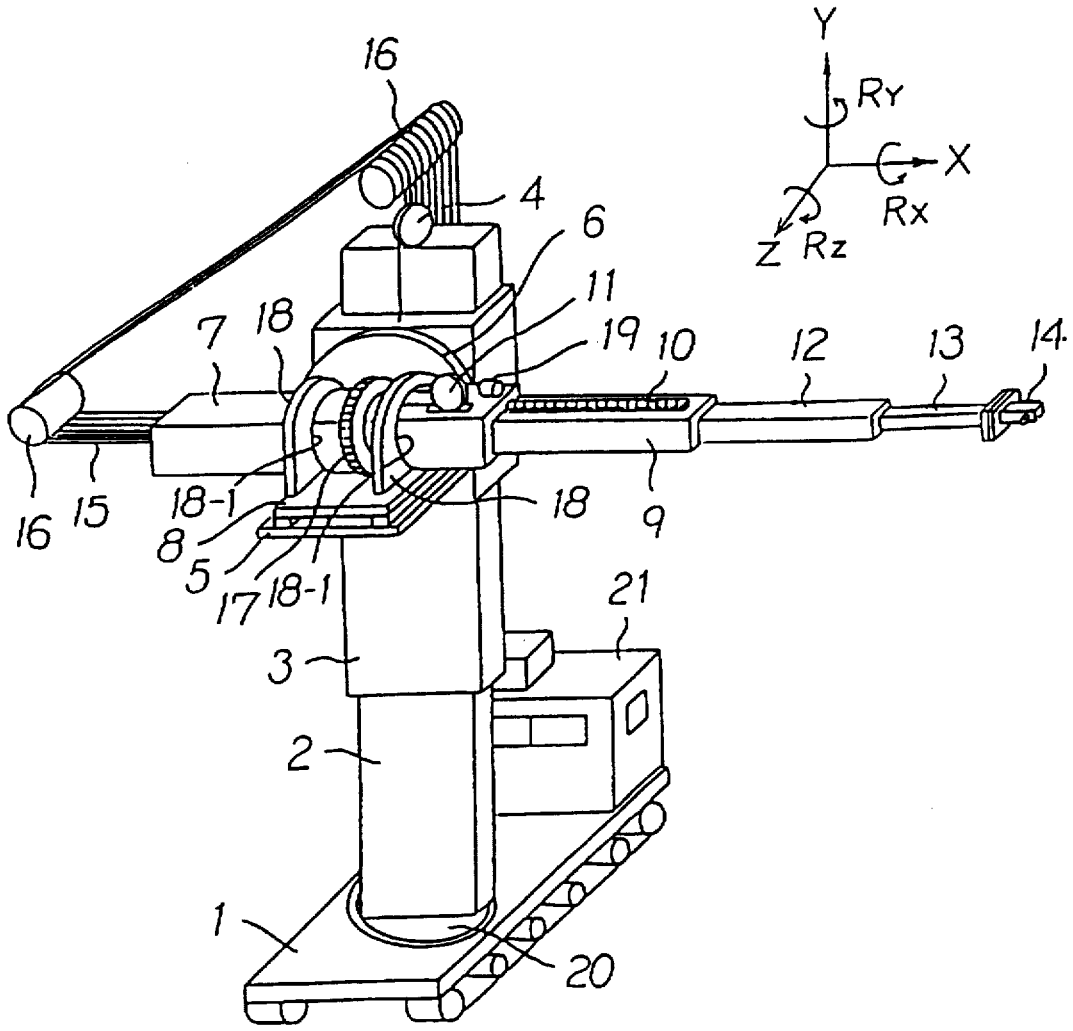
FIG. 1 is a perspective view of a multistage telescopic lance unit for use in a repairing apparatus for a coke oven according to this invention.
Figure 2:
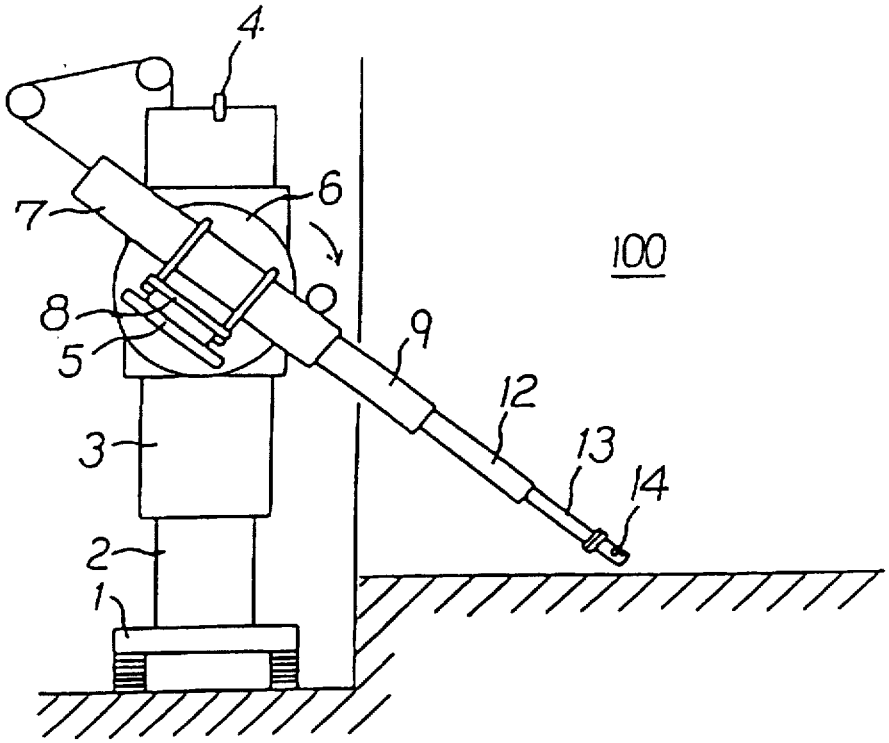
FIG. 2 is a side view for describing a tilting mechanism of the multistage telescopic lance unit illustrated in FIG. 1.
Figure 3:
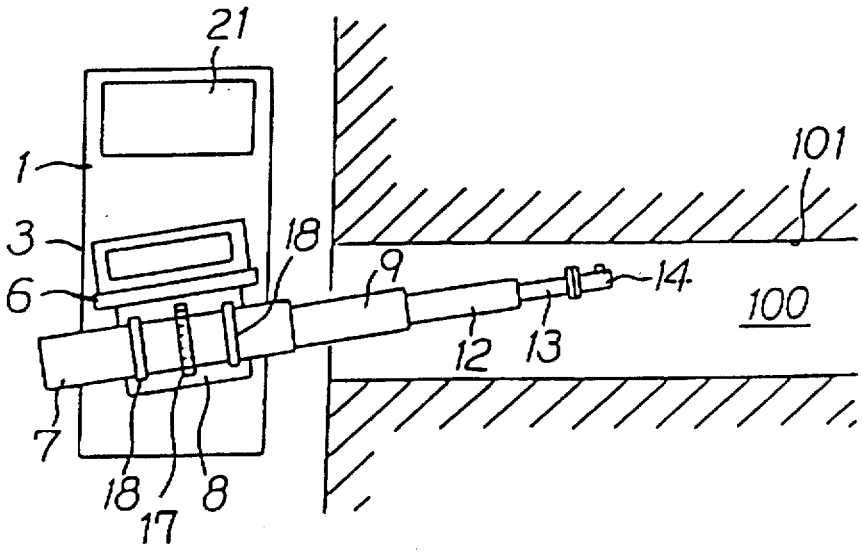
FIG. 3 is a plan view for describing a swinging mechanism of the multistage telescopic lance unit illustrated in FIG. 1.

Now, description will be made as regards embodiments of this invention. FIGS. 1 through 3 show a repairing apparatus according to this invention which comprises a multistage telescopic lance unit as seen from the figures. At first, FIG. 1 shows an orthogonal coordinate system having an X axis along a horizontal plane, a Y axis perpendicular to the horizontal plane, and a Z axis perpendicular to a plane defined by the X axis and the Y axis. Herein, the repairing apparatus according to this invention will be outlined in conjunction with the orthogonal coordinate system. The repairing apparatus is located so that the plane defined by the X axis and the Y axis is parallel to an oven wall surface of a coke oven. In this state, the repairing apparatus is movable on the plane in a linear fashion or in a two-dimensional fashion. Upon completion of repair, the repairing apparatus can be moved along the Z axis to be guided into another coke oven.

The repairing apparatus illustrated in FIG. 1 comprises a lance carriage 1. The lance carriage 1 has a mast 2 which stands upright along the Y axis and which is rotatable around the Y axis. The mast 2 has a lance lifting stand 3 which is movable up and down in a vertical direction, namely, along the Y axis. The lance lifting stand 3 is moved up and down along the mast 2 by a driving unit 4 comprising a hoist which is mounted at the top of the mast 2 and which uses a wire or a chain.

A lance support platform 5 is attached to the lance lifting stand 3 through a tilting gear 6. The lance support platform 5 is provided with a fixed outer cylinder 7 having a rectangular cross section. The fixed outer cylinder 7 is fixed to the lance support platform 5 through a sliding plate 8 slidable in an elongated direction of the lance support platform 5.

The lance tilting gear 6 is rotated in the clockwise or the counterclockwise direction by a drive motor not shown in the figure so that the fixed outer cylinder 7 is tilted and rotated around the Z axis as illustrated in FIG. 2.

Herein, the fixed outer cylinder 7 defines a lance axis at its center and internally supports a first-stage lance 9 comprising a cylindrical member having a rectangular section.

A rack 10 is fixed to an outer surface of the first-stage lance 9 in the axial direction. The rack 10 is engaged with a pinion 11 formed on the fixed outer cylinder 7. The pinion 11 is rotated in the clockwise or the counterclockwise direction by a drive motor not illustrated in the figure so that the first-stage lance 9 is moved forward and backward along the lance axis of the fixed outer cylinder 7.

A second-stage lance 12 comprising a cylindrical member having a rectangular section is assembled into the first-stage lance 9. A third-stage lance 13 comprising a cylindrical member having a rectangular section is assembled into the second-stage lance 12. A lance head portion 14 is formed on a top end of the third-stage lance 13.

Figure 4:
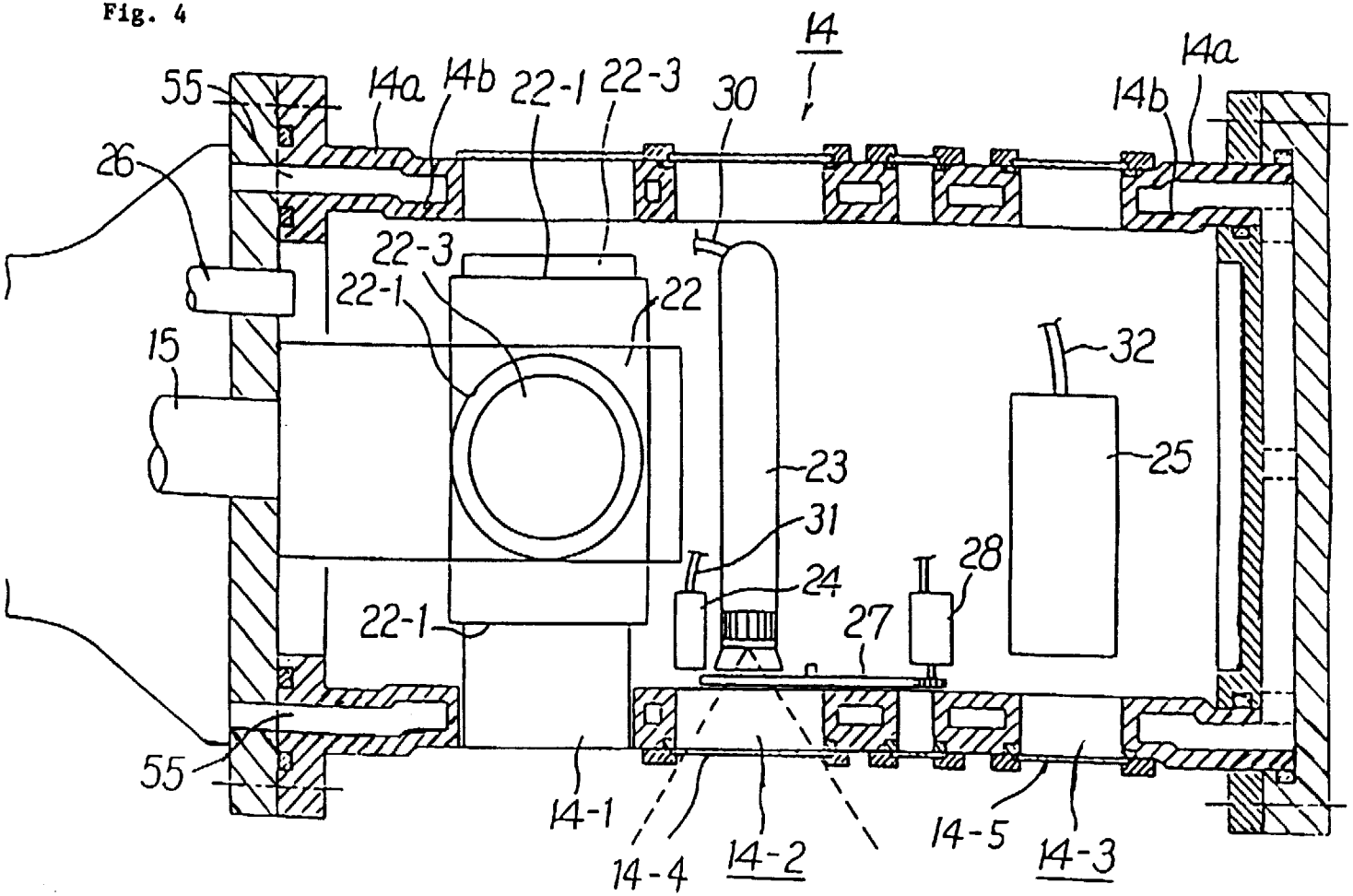
FIG. 4 is a transversal sectional view illustrating a structure of a top end of the multistage telescopic lance unit illustrated in FIG. 1.

As illustrated in FIG. 4, the lance head portion 14 is provided with a repairing nozzle 14-1 for spraying (namely, for injecting) a repairing material. The repairing nozzle 14-1 is supplied with air, oxygen, and the repairing material through a plurality of flexible hoses 15 (only one being illustrated in FIG. 4). The flexible hoses 15 can be extended and wound up by a winding mechanism 16 in response to extension and contraction of the lance.

The fixed outer cylinder 7 is provided with a gear 17 for rotating the first-stage through the third-stage lances 9, 12, and 13 around the lance axis passing through the center of the fixed outer cylinder. By rotating the gear 17 by a motor not illustrated in the figure, the fixed outer cylinder 7 is rotated around the lance axis as illustrated in FIG. 3. In a condition where the fixed outer cylinder 7 is arranged so that the lance axis coincides with the X axis, namely, in a condition where the fixed outer cylinder 7 is horizontally kept, the fixed outer cylinder 7 is rotated around the X axis.

A pair of bearing plates 18 are fixed to the sliding plate 8. The fixed outer cylinder 7 is arranged to pass through circular holes 18-1 formed in the bearing plates 18. A wide-range camera 19 for observation of a condition of an oven wall during repair work is mounted on the fixed outer cylinder 7. With an appropriate countermeasure against heat, the wide-range camera 19 can be arranged at any desired position such as the top end of the second-stage lance 12.

On the other hand, the mast 2 is attached onto the lance carriage 1 through a swinging mechanism 20 to be swingable around the Y axis. An operation room 21 is located on the lance carriage 1 for manipulation of the multi-stage telescopic lance unit.

In this embodiment, a caterpillar system is adopted as a running system of the lance carriage 1. However, since a rail for a coke guide car is laid on a coke side of the coke oven, a carriage may run on the rail instead of the caterpillar type of the carriage and the parts above the swinging mechanism 20 may be exchangeable.

Referring to FIG. 4, the lance head portion 14 is provided with a nozzle head 22 having branched spraying ports 22-1 mounted on top ends of a plurality of the flexible hoses 15. A repairing nozzle 14-1 is connected to one of the spraying ports 22-1 of the nozzle head 22 while a closing plug 22-3 is removably attached to each of the remaining spraying ports 22-1. The repairing nozzle 14-1 opens towards a side surface of the lance head portion 14.

Openings 14-2 and 14-3 are formed in the side surface of the lance head portion 14 to be adjacent to the repairing nozzle 14-1. Within the lance head portion 14, a CCD camera 23 and a radiation thermometer 24 are arranged opposite to the opening 14-2 while a laser range finder 25 for measuring a distance to the oven wall surface is arranged opposite to the opening 14-3. The lance head portion 14 is connected to a compressed cooling air supply pipe 26.

Through slits not shown in the figure but formed at attaching portions of glass plates 14-4 and 14-5 shielding the openings 14-2 and 14-3, respectively, compressed cooling air blown into the lance head portion 14 is spouted to outer surfaces of the glass plates.

A rotary disk 27 rotated by a motor 28 is located in front of the CCD camera 23.

Figure 5:
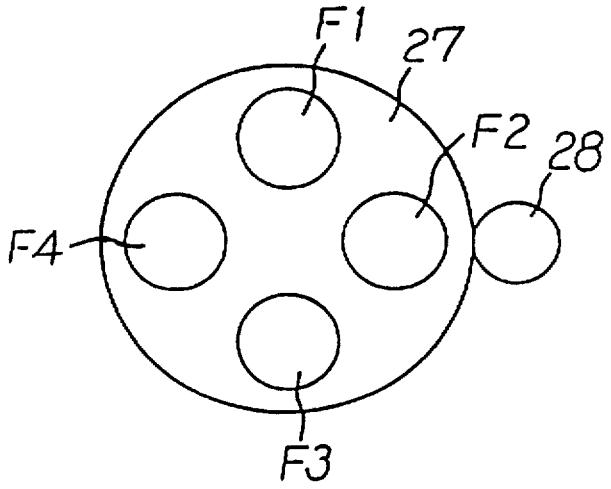
FIG. 5 is a schematic diagram for describing a light shielding filter switching unit located in front of an image pickup device mounted at the top end of the multistage telescopic lance unit illustrated in FIG. 4.

Referring to FIG. 5 in addition to FIG. 4, the rotary disk 27 is provided with a plurality of bandpass filters F1 through F4 equiangularly spaced for shielding and adjusting a light amount and a luminance to be supplied to the CCD camera 23. In correspondence to the condition of the oven wall surface, exposure of the CCD camera 23 is adjusted and the bandpass filters F1 through F4 are switched to selectively pass wavelengths of light from the oven wall. In this manner, those wavelengths of light emitted from the spraying flame are cut off to enable accurate observation of the flame spraying condition of the repairing material.

The laser range finder 25 is for measuring a distance between the top end of the lance and the oven wall surface as well as a depth of a worn or a damaged area in order to quantitatively detect a wear condition of the oven wall as a wear amount. In other words, if a depression due to wear is present in the oven wall, the size and the depth of the depression are detected by measurement data obtained by the laser range finder 25.

An image of the oven wall surface picked up by the CCD camera 23, a temperature of the oven wall measured by the radiation thermometer 24, and the measurement data obtained by the laser range finder 25 are transmitted from the lance head portion 14 through transmission paths 30, 31, and 32, respectively, and then pass through the first-stage through the third-stage lances 9, 12, and 13, the inside of the fixed outer cylinder 7, and the winding mechanism 16 to be taken out and introduced into the operation room 21.

The nozzle head 22 is supplied with the repairing material through the flexible hose 15. The flexible hose 15 is extended from the lance head portion 14 through the first-stage to the third-stage lances 9, 12, and 13, the inside of the fixed outer cylinder 7, and the winding mechanism 16 to be taken out and connected to a repairing material supplying mechanism (not shown).

The above-mentioned multi-stage telescopic lance unit carries out repair by desiredly moving the lance head portion 14 along an oven wall 101 in a coke oven chamber 100 as illustrated in FIGS. 2 and 3 and by spraying the repairing material onto the damaged area of the oven wall 101. As will be understood from the above, it is sufficient that, during the repair work, the lance head portion 14 is moved along the oven wall 101 in a linear fashion or a two-dimensional fashion. Accordingly, at least by making the lance head portion 14 be tilted and rotated around the Z axis and be extended and contracted along the lance axis during repair, it is possible to repair the worn or the damaged area of the oven wall 101. In this event, up-and-down movement along the Y axis is unnecessary.

Figure 6:
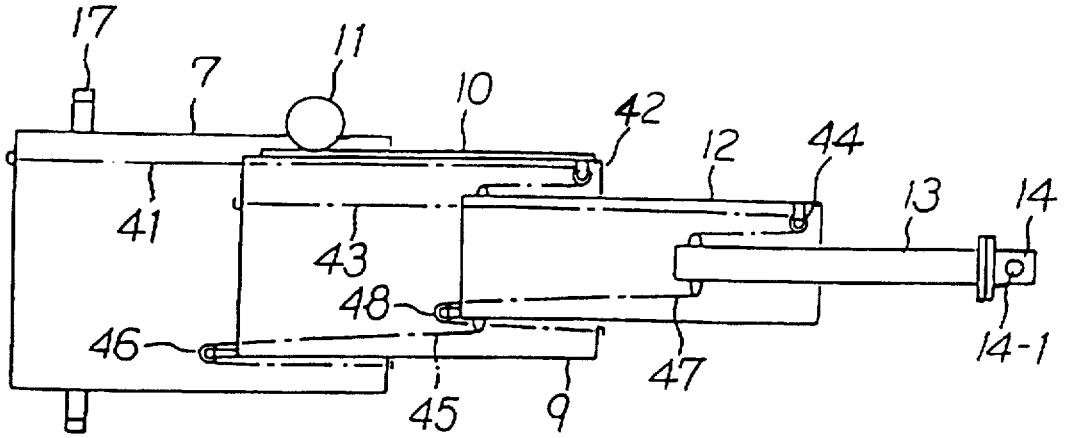
FIG. 6 is a schematic lateral sectional view illustrating an extension driving mechanism of the multistage telescopic lance unit illustrated in FIG. 1.

Referring to FIG. 6, description will be made as regards a first embodiment of the multistage telescopic lance unit. A first wire 41 is for forwardly moving the second-stage lance 12. The first wire 41 has one end fixed to a rear end of the fixed outer cylinder 7 and the other end fixed to a rear end of the second-stage lance 12 after being hung around a first wheel 42 fixed to a front end of the first-stage lance 9.

A second wire 43 is for forwardly moving the third-stage lance 13. The second wire 43 has one end fixed to a rear end of the first-stage lance 9 and the other end fixed to a rear end of the third-stage lance 13 after being hung around a second wheel 44 fixed to a front end of the second-stage lance 12.

A driving mechanism for forwardly moving the second-stage lance 12 and the third-stage lance 13 is as follows. When the pinion 11 is rotated by the drive motor not shown in the figure to advance the first-stage lance 9, the second-stage lance 12 is moved forward by the first wire 41 and the first wheel 42. In cooperation, the third-stage lance 13 is advanced by the second wire 43 and the second wheel 44 over the same distance.

A third wire 45 is for backwardly moving the second-stage lance 12. The third wire 45 has one end fixed to a front end of the fixed outer cylinder 7 and the other end fixed to the rear end of the second-stage lance 12 after being hung around a third wheel 46 fixed to the rear end of the first-stage lance 9.

A fourth wire 47 is for backwardly moving the third-stage lance 13. The fourth wire 47 has one end fixed to the front end of the first-stage lance 9 and the other end fixed to the rear end of the third-stage lance 13 after being hung around a fourth wheel 48 fixed to the rear end of the second-stage lance 12.

Backward movement of the second-stage lance 12 and the third-stage lance 13 is carried out in the manner which will presently be described. The pinion 11 is rotated by the above-mentioned drive motor not illustrated in the figure to withdraw the first-stage lance 9. In this event, the second-stage lance 12 is withdrawn by the third wire 45 and the third wheel 46. In cooperation, the third-stage lance 13 is moved backward by the fourth wire 47 and the fourth wheel 48.

Figure 7:
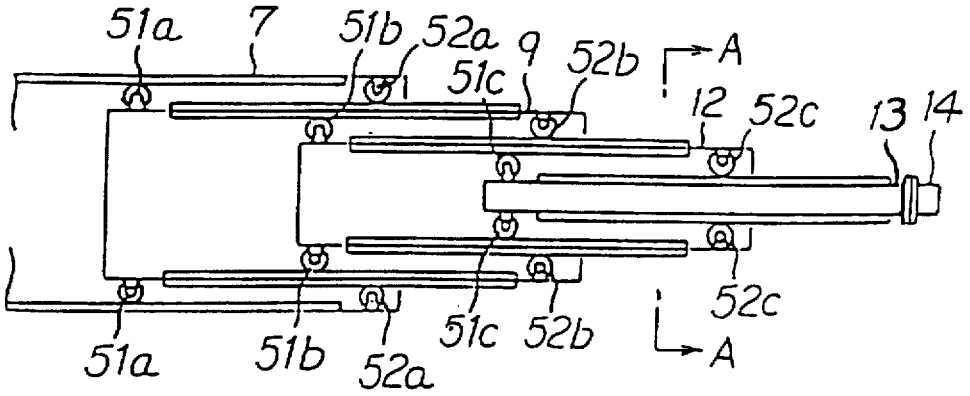
FIG. 7 is a schematic horizontal sectional view illustrating an arrangement of rollers in the extension driving mechanism of the multistage telescopic lance unit illustrated in FIG. 1.

Referring to FIG. 7, description will proceed to a movement guide mechanism of the multistage telescopic lance unit. In order to smooth the relative movement between the fixed outer cylinder 7 and the first-stage lance 9, between the first-stage lance 9 and the second-stage lance 12, and between the second-stage lance 12 and the third-stage lance 13, first through sixth roller pairs 51*a* through 51*c* and 52*a* through 52*c* are provided. The first through the third roller pairs 51*a*, 51*b*, and 51*c* are fixed to left and right opposite outer surfaces of the first-stage lance 9, the second-stage lance 12, and the third-stage lance 13, respectively, at the rear ends thereof. The fourth through the sixth roller pairs 52*a*, 52*b*, and 52*c* are fixed to left and right opposite inner surfaces of the fixed outer cylinder 7, the first-stage lance 9, and the second-stage lance 12, respectively, at the front ends thereof.

Figure 8:
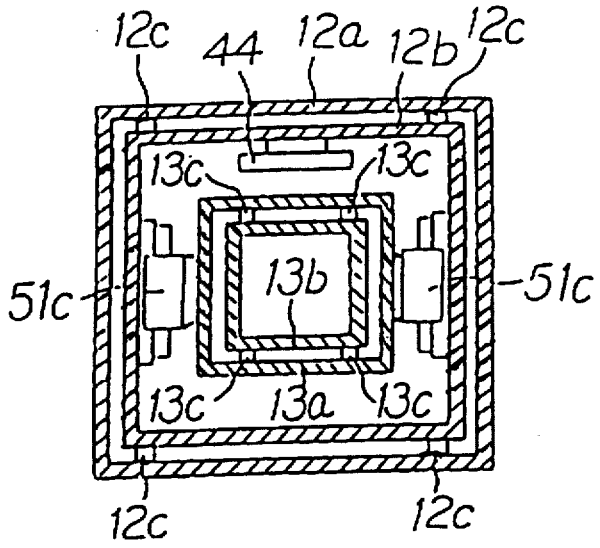
FIG. 8 is a longitudinal sectional view of a first example of the multistage telescopic lance unit, taken along a line A—A in FIG. 7.

Referring to FIG. 8, the second-stage and the third-stage lances 12 and 13 comprise double cylindrical members 12*a*, 12*b* and 13*a*, 13*b*, respectively, having a rectangular cross section. Gaps are defined between the cylindrical members 12*a* and 12*b* and between 13*a* and 13*b* and are divided by a plurality of partitioning members 12*c* and 13*c*, respectively, extending along the lance center axis to form a plurality of cooling water flow paths. Thus, a water-cooling jacket structure is achieved. Although the first-stage lance and the fixed outer cylinder 7 are not illustrated in FIG. 8, such structure is also applied to the first-stage lance 9. Cooling water is supplied and discharged through flexible hoses individually to and from the first-stage through the third-stage lances 9, 12, and 13.

Turning back to FIG. 4, the lance head portion 14 coupled to the top end of the third-stage lance 13 comprises double cylindrical members 14*a* and 14*b*, like the above-mentioned water-cooling jacket structure. Cooling water flow paths are formed in a gap defined therebetween to achieve another water-cooling jacket structure. In this connection, a predetermined number of cooling water passage holes 55 are formed at a coupling surface between the third-stage lance 13 and the lance head portion 14. In such a water-cooling jacket structure, cooling water is supplied through a part of a plurality of the cooling water flow paths, for example, through the flow paths formed, among top, bottom, left side, and right side surfaces, at the top and the bottom surfaces while the cooling water is discharged through the flow paths formed at the left and the right side surfaces. With this structure, it is possible to prevent the lance from being deformed due to drift of the cooling water.

Figure 9:
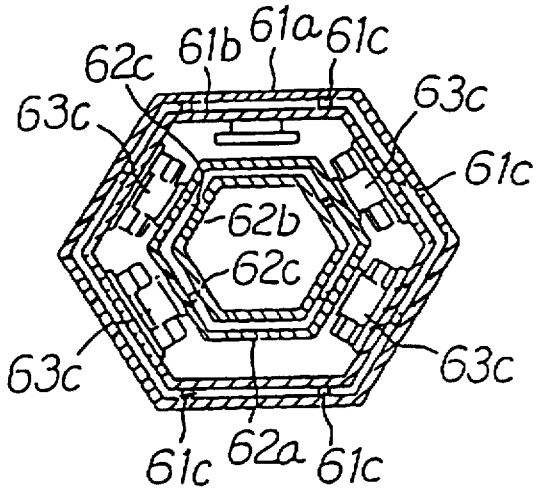
FIG. 9 is a longitudinal sectional view of a second example of the multistage telescopic lance unit, taken along a line A—A in FIG. 7.

In FIG. 8, the first-stage through the third-stage lances 9, 12, and 13 and the fixed outer cylinder 7 comprise the cylindrical members having a rectangular section. However, as illustrated in FIG. 9, use may be made of double cylindrical members 61*a*, 61*b* and 62*a*, 62*b* having a hexagonal section. In this event, four rollers 63*c* are arranged in left and right spaces, four in number, defined between an inner surface of the inner cylindrical member 61*b* of the second-stage lance and an outer surface of the outer cylindrical member 62*a* of the third-stage lance. A plurality of partitioning portions 61*c* and 62*c* extending along the center axis are formed between the double cylindrical members 61*a* and 61*b* and between the double cylindrical members 62*a* and 62*b*, respectively.

Figure 10:
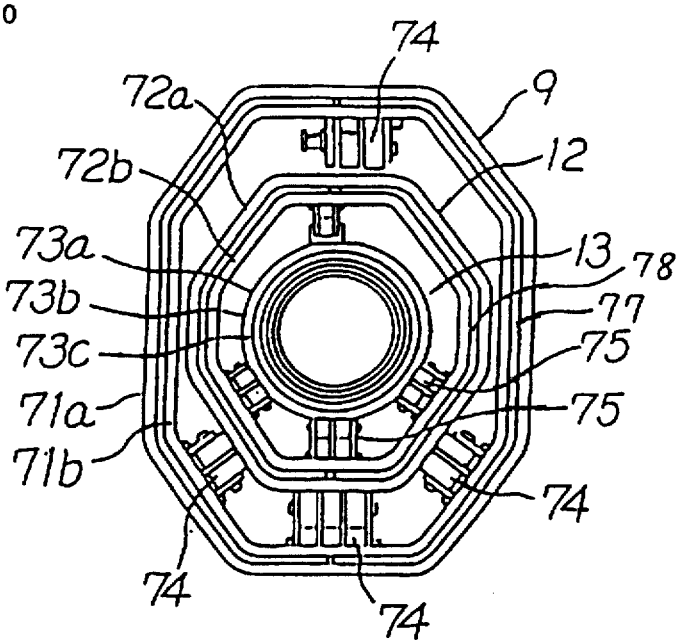
FIG. 10 is a longitudinal sectional view of a third example of the multistage telescopic lance unit, taken along a line A—A in FIG. 7.

Referring to FIG. 10, the first-stage and the second-stage lances 9 and 12 comprise double cylindrical members 71*a*, 71*b* and 72*a*, 72*b* having an octagonal cross section, respectively. The third-stage lance 13 comprises triple cylindrical members 73*a*, 73*b*, and 73*c* having a circular cross section. In this case also, four rollers 74 are arranged in a space defined between an inner surface of the inner cylindrical member 71*b* of the first-stage lance and an outer surface of the outer cylindrical member 72*a* of the second-stage lance. Likewise, four rollers 75 are arranged in a space defined between an inner surface of the inner cylindrical member 72*b* of the second-stage lance and an outer surface of the outer cylindrical member 73*a* of the third-stage lance. The arrangement of the rollers 74 and 75 are asymmetrical, for example, three at a lower portion and one at an upper portion. This arrangement is selected taking the weight of the lance into consideration and gives no influence upon extension and contraction of each stage. A plurality of partitioning portions 77 and 78 extending along the center axis are formed between the double cylindrical members 71*a* and 71*b* and between the double cylindrical members 72*a* and 72*b*, respectively.

Figure 11:
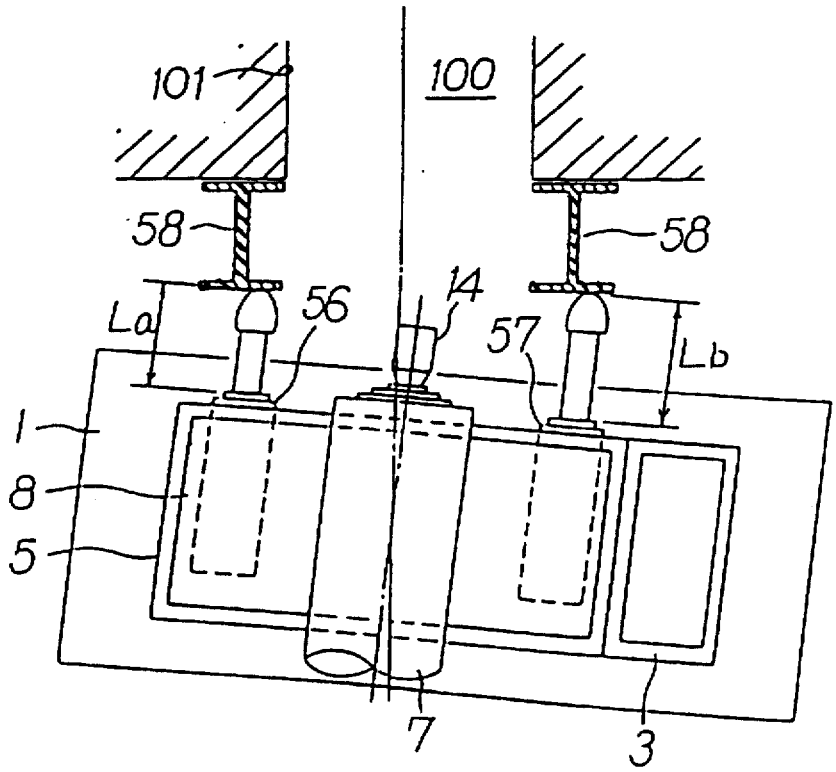
FIG. 11 is a view for describing an operation of arranging a lance carriage of the repairing apparatus in parallel to a front side of the oven.
Figure 12:
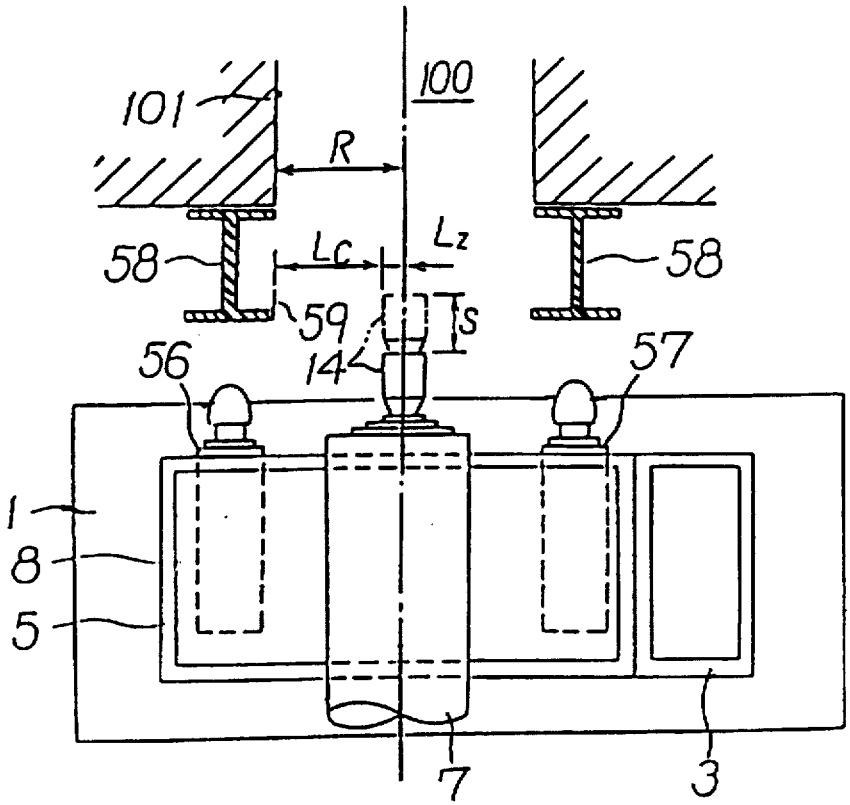
FIG. 12 is a view for describing an operation of positioning the multistage telescopic lance unit at the center of the oven.

Referring to FIGS. 11 and 12, description will be made as regards positioning of the multistage telescopic lance unit. Generally, a pair of buckstays 58 are arranged at an entrance of the coke oven. Taking this into consideration, stroke cylinders 56 and 57 are formed on both sides of the lance support platform 5 at positions corresponding to the buckstays 58.

The stroke cylinders 56 and 57 are for measuring distances La and Lb between the lance support platform 5 and the buckstays 58 so as to position the lance support platform 5 in parallel to the buckstays 58. On the other hand, a reflector plate 59 (FIG. 12) is arranged at a predetermined level of the buckstays 58. The laser range finder 25 (FIG. 4) contained in the lance head portion 14 of the multistage telescopic lance unit measures a distance between the reflector plate 59 and the lance head portion 14 so as to position the center of the multistage telescopic lance unit at the center of the coke oven chamber 100 in a widthwise direction.

Figure 13:
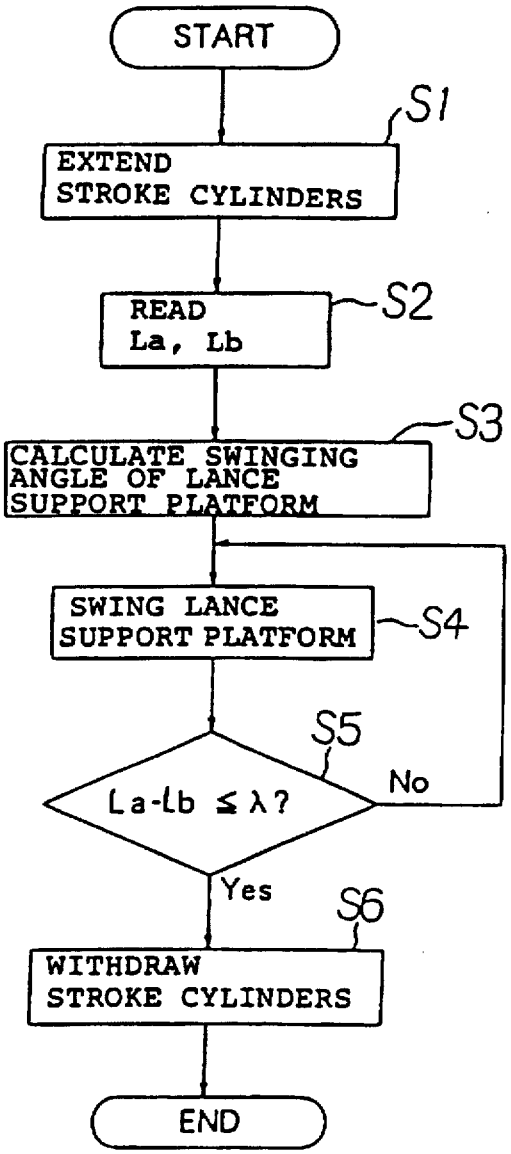
FIG. 13 is a flow chart for describing the operation of arranging the lance carriage in parallel as illustrated in FIG. 11.

Referring to FIG. 13, description will proceed to a positioning operation of the multistage telescopic lance unit. It is assumed here that the oven wall 101 of the coke oven chamber 100 in the coke oven is observed or the damaged area of the oven wall 101 is repaired. In this event, an operator in the operation room 21 at first makes the lance carriage 1 run and move to a position in front of a furnace, namely, a coke oven of the coke oven chamber 100 to be observed or repaired. Subsequently, the stroke cylinders 56 and 57 are operated to be brought into contact with the buckstays 58 and 58 (step S1). Distances La and Lb are read (step S2). In a step S3, calculation is made of a swinging angle of the lance support platform 5 to swing the lance support platform 5 (step S4). In a step S5, judgement is made whether or not the distances La and Lb are not greater than a predetermined value λ. When it is detected as a result of judgement that they are not greater than the predetermined value λ, the stroke cylinders 56 and 57 are withdrawn (step S6). Then, parallel positioning between the lance support platform 5 and the coke oven is completed.

Figure 14:
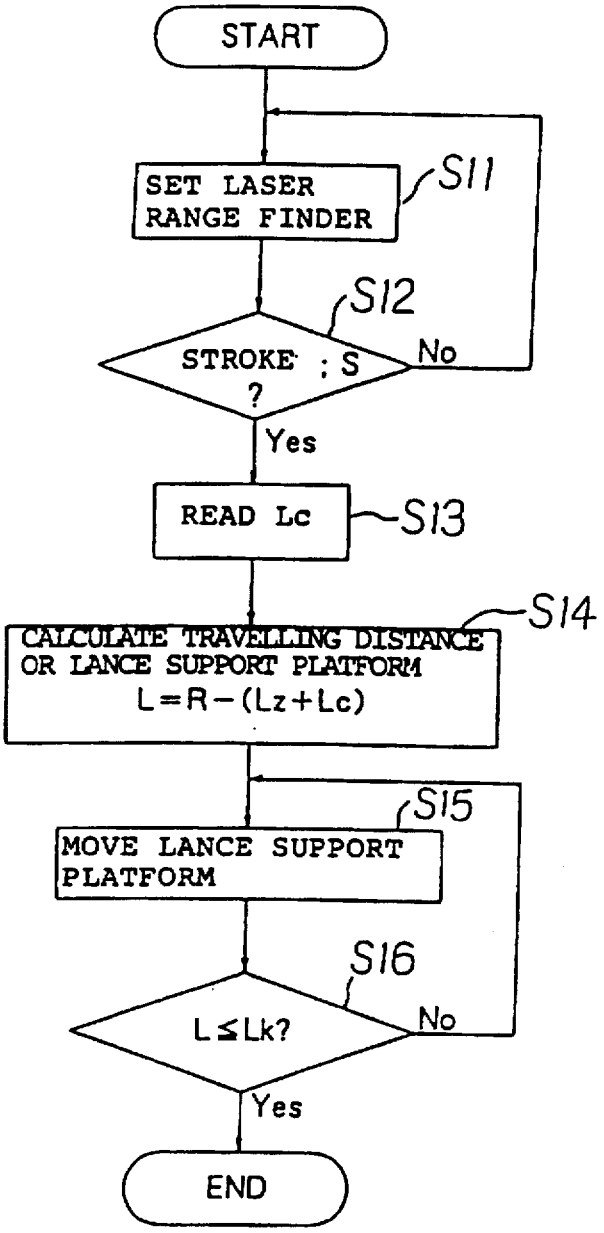
FIG. 14 is a flow chart for describing the operation of positioning the multistage telescopic lance unit at the center of the oven as illustrated in FIG. 12.

Referring to FIG. 14 in addition to FIG. 12, in a step S11, the pinion 11 is rotated by driving the motor not shown in the figure to thereby extend the multistage telescopic lance unit through the rack 10. The laser range finder 25 contained in the lance head portion 14 is located at a position opposite to the reflector plate 59 (step S12). Subsequently, a distance Lc between the laser range finder 25 and the reflector plate is read (step S13). A travelling distance Lz of the lance support platform 5 along the Z axis is calculated in accordance with the following equation (step S14).

$$L=R-(Lz+Lc)$$

Herein, R and Lz represents a distance between the oven wall surface and the oven center and a distance between a center line of the multistage telescopic lance unit and the laser range finder 25, respectively.

In a step S15, the lance support platform 5 is moved along the Z axis. The operation proceeds to a step S16 to judge whether or not the distance Lz is not greater than a predetermined allowance Lk. When it is detected as a result of judgement that the distance Lz is not greater than the predetermined allowance Lk, positioning of the multistage telescopic lance unit at the center of the the oven is completed. Now, the position of the top end of the lance before extension is set as a reference point (0, 0, 0) on the X, Y, and Z axes.

Subsequently, the pinion 11 is rotated by driving the motor not shown in the figure to extend, through the rack 10, the multistage telescopic lance unit which is thereby inserted to a predetermined position in the coke oven chamber 100. The multistage telescopic lance unit scans the oven wall to be repaired. The CCD camera 23 contained in the lance head portion 14 picks up a condition of the oven wall as an image of the oven wall to be displayed on a repair monitor which will later be described. The repair monitor displays a wearing status image along the X and the Y axes at a coordinate corresponding to the travelling distances of a repairing material spraying position at the top end of the lance along the X, the Y, and the Z axes from the reference point (0, 0, 0) on the X, the Y, and the Z axes. With respect to the reference point (0, 0, 0) on the X, the Y, and the Z axes as a start point, an absolute position of the repairing material spraying position is calculated from driving amount information supplied from a lance driving system, which will later be described, to a signal processing control section in the operation room 21 and is corrected by an estimated flexure of the top end of the lance.

Next, supplied with wear amount data of the oven wall from the laser range finder 25 and with position coordinate data of the depression in the oven wall resulting from wear, the signal processing control section carries out image processing and classifies each portion of the oven wall by the level of wear, namely, the depth of the depression to display a wear distribution chart on the repair monitor.

With reference to observation data of the wear distribution chart and the display of the monitor, the operator indicates a required repair range of the oven wall surface and enters selection of a predetermined repair pattern to the signal processing control section. As a result, a control signal is delivered to the lance driving system in accordance with the predetermined repair pattern. The lance driving system is responsive to the control signal and controls the multistage telescopic lance unit to carry out automatic repair.

The first-stage through the third-stage lances 9, 12, and 13 and the lance head portion 14 of the multistage telescopic lance unit have the water-cooled structure. Compressed cooling air is blown from the compressed cooling air supply pipe 26 into the lance head portion 14 containing the CCD camera 23, the radiation thermometer 24, the laser range finder 25, the rotary disk 27 with the light shielding bandpass filters, and the motor 28. The compressed cooling air is spouted through the slits formed at the attaching portions of the glass plates 14-4 and 14-5 attached to the openings 14-2 and 14-3, respectively, to the outer surfaces of the glass plates. Thus, the spraying material is prevented from depositing to the outer surfaces of the glass plates 14-4 and 14-4 due to rebounding.

In dependence upon the condition of the wall surface, selection is made of one of the bandpass filters F1 through F4 of the rotary disk 27 formed in front of the CCD camera 23 and rotated by the motor 28. By adjusting exposure of the CCD camera 23 and by selectively transmitting the wavelengths of light from the oven wall through the shielding filter thus selected, the wavelengths of light emitted from the spraying flame are cut off. It is therefore possible to observe the flame spraying condition of the repairing material. The lance head portion 14 can be removed from the third-stage lance 13. On the other hand, the nozzle head 22 contained in the lance head portion 14 has a plurality of the branched spraying ports 22-1 as described in the foregoing. With this structure, it is possible to observe and repair left side and right side oven walls 101 and a ceiling by changing an attaching position of the repairing nozzle 14-1 as illustrated in FIGS. 15(*a*)–15(*c*).

Figure 15A:
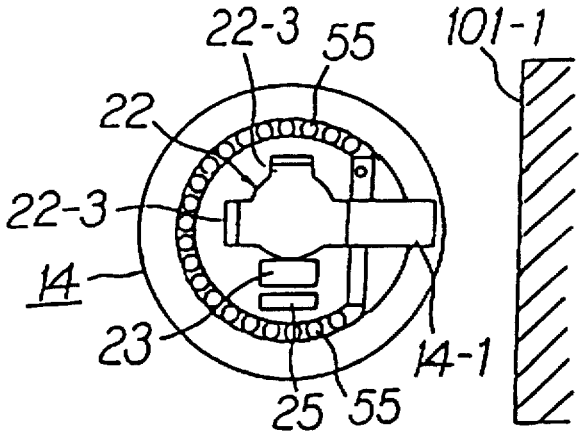
FIGS. 15(*a*)–15(*c*) are for describing modifications of the placement of an injection nozzle mounted at the top end of the multistage telescopic lance unit.
Figure 15B:
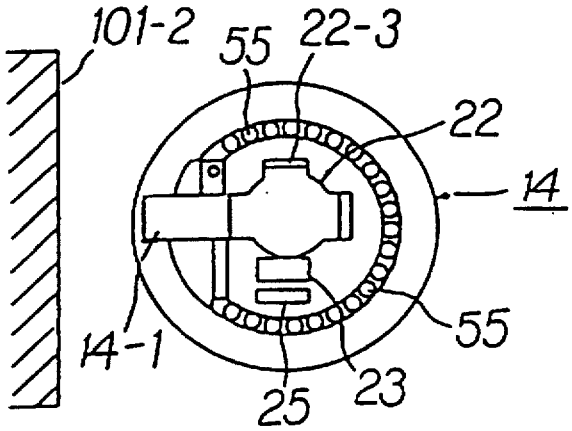
Figure 15C:
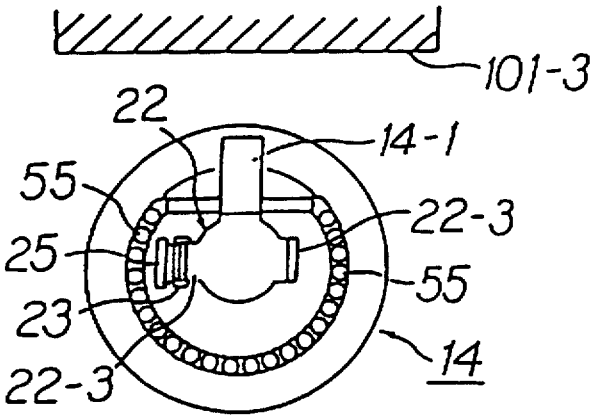

Specifically, FIG. 15(*a*) shows the attaching position of the repairing nozzle 14-1 in case where the right side oven wall 101-1 is observed and repaired. FIG. 15(*b*) shows the attaching position of the repairing nozzle 14-1 in case where the left side oven wall 101-2 is observed and repaired.

On the other hand, FIG. 15(*c*) shows the attaching position of the repairing nozzle 14-1 in case where the ceiling oven wall 101-3 is observed and repaired.

In the multistage telescopic lance unit of the repairing apparatus according to this invention, the travelling distance of the first-stage lance 9 is equal to those of the second-stage lance 12 and the third-stage lance 13. Accordingly, it is easy to calculate the position of the repairing nozzle 14-1 of the lance head portion 14 at the top end of the lance. Furthermore, since the multistage telescopic lance unit has a polygonal section, the rotation of the fixed outer cylinder 7 around the axis is reliably transmitted to the first-stage through the third-stage lances 9, 12, and 13 and the lance head portion 14.

Referring to FIGS. 16 through 20, description will now proceed to a repairing method by the use of the above-mentioned multistage telescopic lance unit.

Figure 16:
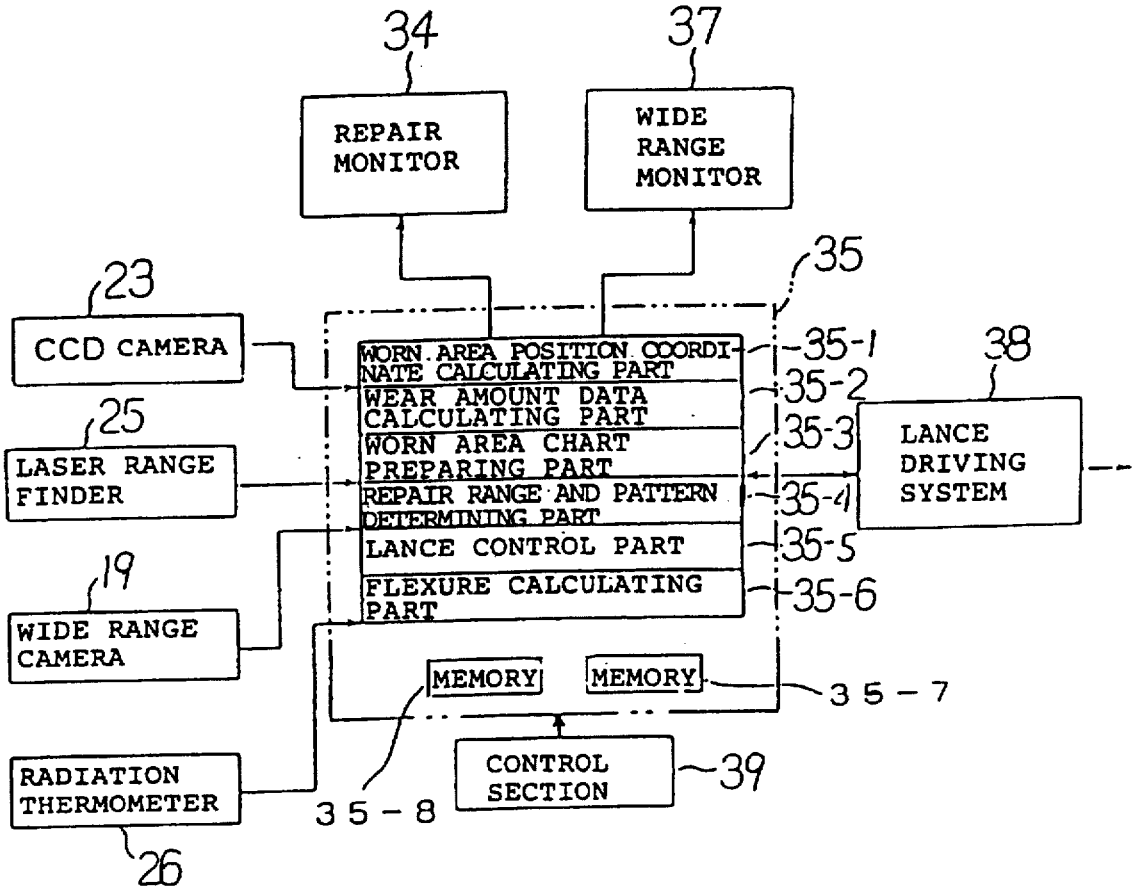
FIG. 16 is a block diagram illustrating a processing section in the repairing apparatus according to this invention with a signal processing control section at its center.

Referring to FIG. 16, the operation room 21 (FIG. 1) is equipped with the repair monitor 34 for use in repairing a wall surface, the signal processing control section 35 for image processing of a wear amount, a graphic panel (not shown) for displaying a processed image, other measuring units, and a console.

The signal processing control section 35 is implemented by a computer and has at least the following functions as will presently become clear. Specifically, the signal processing control section 35 has the functions of a worn area position coordinate calculating part 35-1 for calculating a position coordinate of a worn area, a wear amount data calculating part 35-2 for calculating the wear amount, a worn area chart preparing part 35-3 for preparing a worn area chart, a repair range and pattern determining part 35-4 for determining a repair range and a repair pattern, a lance control part 35-5, and a flexure calculating part 35-6 for calculating a flexure of the top end of the lance. An image picked up by the wide range camera 19 (FIG. 1) mounted on the fixed outer cylinder 7 (FIG. 1) is displayed on a wide range monitor 37. The illustrated signal processing device 35 further comprises a memory 35-7 storing a program for controlling the above-mentioned parts, and another memory 35-8 which will later be described.

Each drive portion in the multistage telescopic lance unit is controlled by a lance driving system 38 using a servo motor or the like. Specifically, the lance driving system 38 controls a position and a velocity of each drive portion, detecting an X-axis travelling amount Lx, a Y-axis travelling amount Ly, a Z-axis travelling amount Lz, a rotation angle $R_X$, a swinging angle $R_Y$, and a tilting angle $R_Z$ illustrated in FIG. 1. The lance driving system delivers those information to the signal processing control section 35 in the operation room 21. In addition to the above-mentioned functions, the signal processing control section 35 has a function of a multilayer neural network supplied with the X-axis travelling amount Lx, the Y-axis travelling amount Ly, and a rotation angle θ around the Z axis for producing a flexure ε of the top end of the lance.

The multilayer neural network responds to the X-axis travelling amount Lx, the Y-axis travelling amount Ly, and the rotation angle θ around the Z axis and produces an estimated value of the flexure ε of the top end of the lance from them. The position of the top end of the lance driven by the lance driving system 38 is corrected by the use of the estimated value.

The signal processing control section 35 is connected to the repair monitor 34 for displaying the image of the wall surface supplied from the CCD camera 23 and to the wide range monitor 37 for displaying the image supplied from the wide range camera 19.

In the above-mentioned structure, the signal processing control section 35 is responsive to the signal supplied from the laser range finder 25 and calculates the wear amount data of the oven wall surface. In addition, the signal processing control section is responsive to the detection signal of the laser range finder 25 and the driving amount of the lance driving system 38 and calculates the position coordinate of the worn area of the oven wall with respect to the top end of the lance.

The signal processing control section 35 carries out image processing by the use of the image information of the wall surface in the repair monitor 34, the wear amount data, and the position coordinate data of the worn area and classifies each portion of the oven wall by the level of wear to produce the wear distribution chart which is displayed on the repair monitor 34 or another graphic panel.

An operating section 39 is for the operator, who observes the wear distribution chart displayed on the repair monitor 34, to enter designation of the required repair range of the oven wall surface and the repair pattern.

When the damaged area of the oven wall in the coke oven is repaired, the operator at first operates the operating section 39 in the operation room 21 to move the lance carriage 1 to the position in front of the coke oven of the predetermined coke oven chamber. As described in conjunction with FIGS. 11 and 13, the lance carriage 1 is positioned at a predetermined location so that the distances between the buckstays 58 on both sides and the lance support platform 5 are not greater than the predetermined value.

Then, as described in conjunction with FIGS. 12 and 14, the fixed outer cylinder 7 is moved along the Y axis and the Z axis through the sliding plate 8 so that the center of the lance is positioned at the center of the coke oven chamber. When the center of the lance is positioned at the center of the coke oven chamber as a result of the movement, the position of the top end of the lance at that time instant before extension of the lance is set as a reference point (0, 0, 0) on the X, the Y, and the Z axes.

Figure 17:
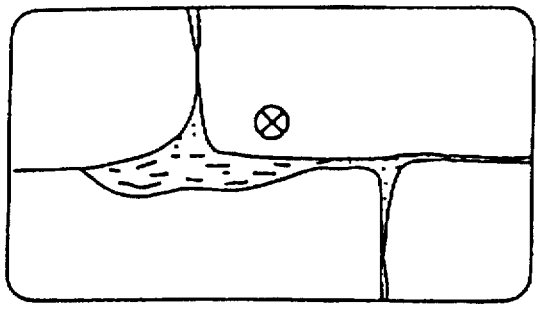
FIG. 17 shows an image of an oven wall in a restricted range as obtained by the repairing apparatus according to this invention.

Once the reference point is set, the operator operates the lance driving system 38 to insert the lance into the coke oven and to make the lance scan the oven wall to be repaired. The condition of the oven wall is picked up by the CCD camera 23 at the top end of the lance, namely, in the lance head portion. By this image pickup operation, an image of the oven wall in a restricted range (for example, 1 m by 1 m) is displayed on the repair monitor 34 as illustrated in FIG. 17. The display on the repair monitor 34 shows the wearing status image along the X and the Y axes at the coordinate corresponding to the travelling distances of the repairing material spraying position at the top end of the lance along the X, the Y, and the Z axes with respect to the reference point (0, 0, 0) on the X, the Y, and the Z axes.

The above-mentioned movement of the lance is performed by the lance driving system 38. Driving amount information of each drive portion is supplied from the lance driving system 38 to the signal processing control section 35. An absolute position of the repairing material spraying position is calculated from the driving amount information with respect to the reference point (0, 0, 0) on the X, the Y, and the Z axes as a start point and is corrected by estimation of the flexure ε of the top end of the lance. The wide range monitor 37 displays an image of the oven wall in a relatively wide range as illustrated in FIG. 18.

Subsequently, the signal processing control section 35 carries out image processing of the image information of the oven wall in the restricted range illustrated in FIG. 17, the wear amount data of the oven wall supplied from the laser range finder 25, and the position coordinate data of the depression in the oven wall resulting from wear. By this image processing, the signal processing control section 35 classifies each portion of the oven wall by the level of wear, namely, the depth of the depression to make the wear distribution chart be displayed on the repair monitor 34, as illustrated in FIG. 19.

Figure 18:
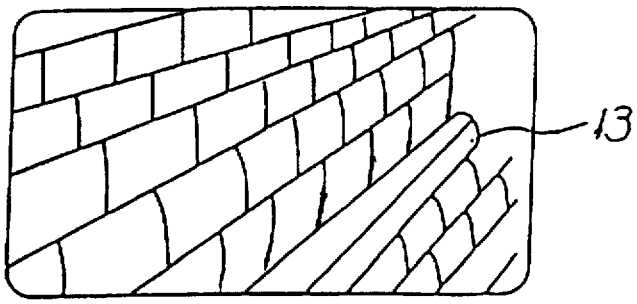
FIG. 18 shows an image of the oven wall in a relatively wide range as obtained by a wide-range camera used in the repairing apparatus according to this invention.
Figure 19:
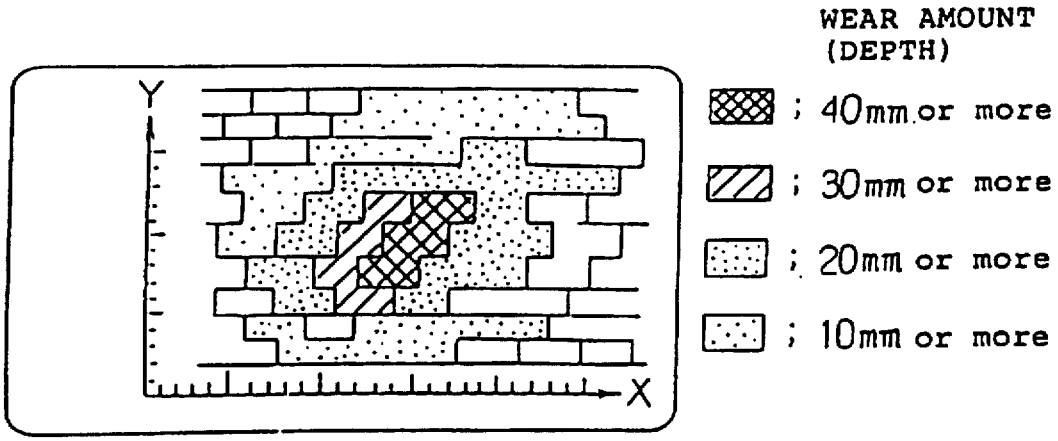
FIG. 19 shows an image representative of observation data of a wear distribution chart of a damaged area as prepared according to this invention.
Figure 20:
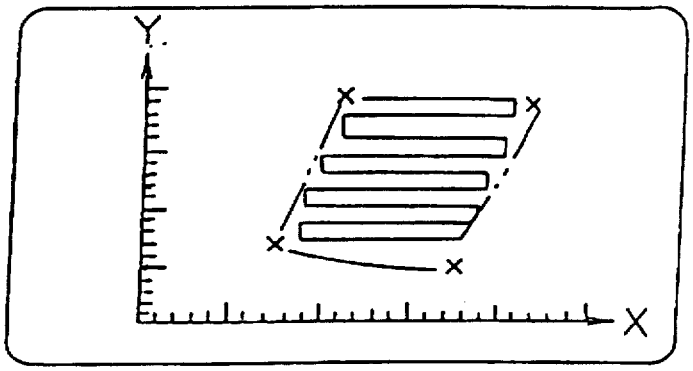
FIG. 20 shows an image of one example of a repair range and a repair pattern used in this invention.

With reference to observation data of the wear distribution chart in FIG. 19, a temperature of the oven wall detected by the radiation thermometer 24, and the display on the monitor in FIG. 18, the operator operates the operating section 39 to indicate a required repair range of the oven wall surface and selects a predetermined repair pattern, as illustrated in FIG. 20. The signal processing control section 35 is responsive to the repair pattern entered through the operating section 39 and delivers a control signal to the lance driving system 38 to control the lance driving system 38. Thus, automatic repair is carried out by the multistage telescopic lance unit.

Referring to FIG. 20, the required repair range is represented by a rectangle formed by connecting four points marked with crisscrosses. The repair pattern is a pattern such that the repair range is scanned from top to bottom in a zigzag fashion. The repair pattern can be determined as desired and may be selected from preselected ones or determined by manual operation of the operator. During this repairing operation, the image of the oven wall in a relatively wide range is picked up by the wide range camera 19 and displayed on the wide range monitor 37. It is therefore possible to confirm, from the outside of the oven, the condition of repair work without any influence of dust, smoke, and high-temperature flame caused by spraying the repairing material.

When the lance does not reach the bottom of the oven even if the lance lifting stand 3 is moved down to a lowest level, the lance driving system 38 is operated through the signal processing control section 35 to carry out position control so that the lance extension length and the tilting angle $R_Z$ are relatively varied by using a relationship of a trigonometric function. Thus, the top end of the lance can be made to approach the bottom of the oven to carry out repair.

When the distance between the lance inserted into the oven and the wall surface does not coincide with a selected distance, the lance driving system 38 is operated through the signal processing control section 35 in the similar manner as mentioned above to control the lance extension length and the swinging angle $R_Y$ so that the distance between the repairing nozzle 14-1 and the oven wall surface is kept constant. As a consequence, the worn area preliminarily detected can be automatically repaired in accordance with any desired pattern.

Next referring to FIGS. 21 through 29, description will be made as regards an automatic repairing method according to a second embodiment. In this embodiment also, use is made of the multistage telescopic lance unit having the structure illustrated in FIG. 16.

Figure 21:
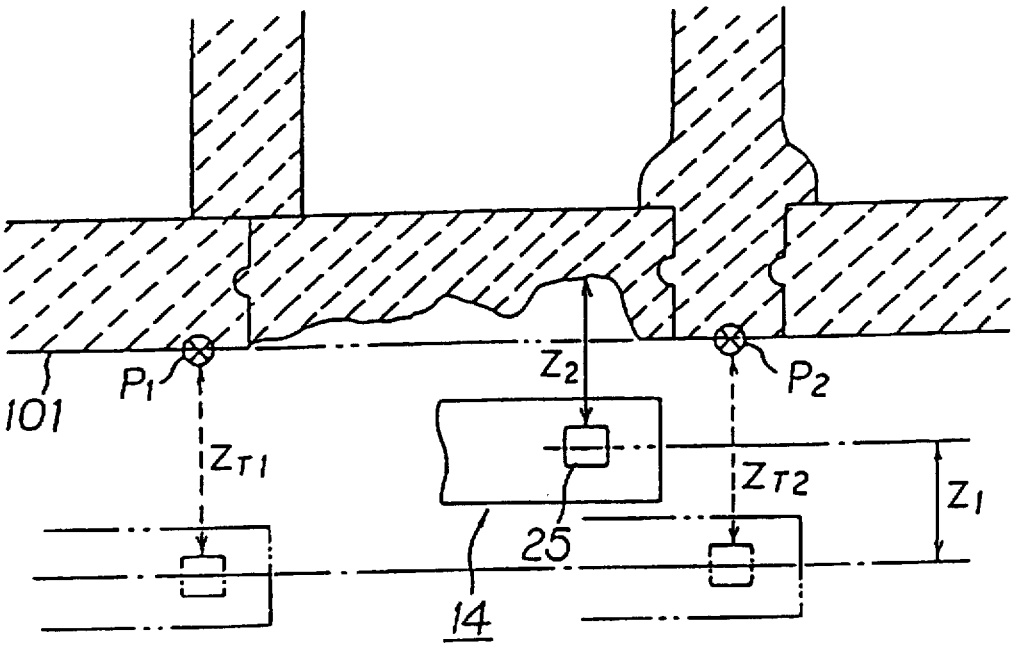
FIG. 21 is a view for describing an operation of preventing protrusion of a spraying material by the use of a second method according to this invention.

Referring to FIG. 21, the laser range finder 25 measures the distance between the top end of the lance and the wall surface in order to quantitatively detect the wear condition of the oven wall 101 as the wear amount data. Specifically, in presence of the depression in the wall surface resulting from wear, the size and the depth of the depression can be obtained by the measurement data detected by the laser range finder 25.

As described in conjunction with FIG. 16, the signal processing control section 35 is responsive to the signal supplied from the laser range finder 25 and calculates the wear amount data of the oven wall surface. In addition, the signal processing control section is responsive to the driving amount data in the lance driving system 38 and calculates the position coordinate of the worn area of the oven wall with respect to the top end of the lance. The signal processing control section 35 carries out image processing by the use of the image information of the wall surface in the repair monitor 34, the wear amount data, and the position coordinate data of the worn area and classifies each portion of the oven wall by the level of wear to produce the wear distribution chart which is displayed on the repair monitor 34 or another graphic panel.

As described above, the signal processing control section 35 has the memory 35-8. The memory 35-8 preliminarily memorizes, as basic motion patterns for the repairing nozzle 14-1, a horizontal reciprocal motion pattern illustrated in FIG. 22(*a*), a vertical reciprocal motion pattern illustrated in FIG. 22(*b*), a circular motion pattern illustrated in FIG. 22(*c*), and a stop pattern illustrated in FIG. 22(*d*).

Figure 23:
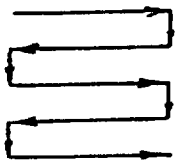
FIGS. 23(*a*)–23(*f*) show basic travelling patterns of the injection nozzle within the repair range.
Figure 23:
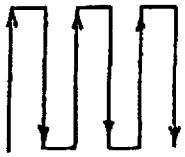
Figure 23:
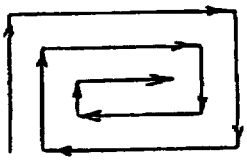
Figure 23:
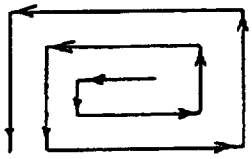
Figure 23:
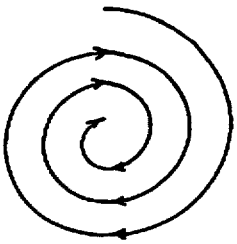
Figure 23:
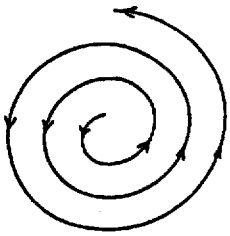

The memory 35-8 of the signal processing control section 35 further memorizes travelling patterns as illustrated in FIGS. 23(*a*)–23(*f*). For example, FIG. 23(*a*) shows a travelling pattern comprising a combination of a horizontal movement and a vertical movement within the repair range. On the other hand, FIG. 23(*b*) shows a travelling pattern comprising a combination of the vertical movement and the horizontal movement. FIG. 23(*c*) shows a spiral travelling pattern comprising a combination of the vertical movement and the horizontal movement from the outside to the inside. FIG. 23(*d*) shows another spiral travelling pattern comprising a combination of the vertical movement and the horizontal movement from the inside to the outside. FIG. 23(*e*) shows another spiral travelling pattern from the outside to the inside. FIG. 23(*f*) shows another spiral travelling pattern from the inside to the outside. Such travelling patterns can readily be achieved by the use of the multistage telescopic lance unit capable of executing the above-mentioned motions with respect to the X, the Y, and the Z axes.

In order to carry out repair, the operator operates the operating section 39 in the operation room 21 to move the lance carriage 1 to the position in front of the oven of the predetermined coke oven chamber.

Then, as described in conjunction with FIGS. 11 and 13, the lance support platform 5 is positioned at the predetermined location so that the distances between the buckstays 58 on both sides and the lance support platform 5 are not greater than the predetermined value. Subsequently, as described in conjunction with FIGS. 12 and 14, the fixed outer cylinder 7 is moved along the Z axis through the sliding plate 8 so that the center of the lance is positioned at the center of the coke oven chamber. The position of the top end of the lance before extension and at the time instant when the center of the lance is positioned at the center of the coke oven chamber is set as a reference point (0, 0, 0) on the X, the Y, and the Z axes.

Subsequently, the operator operates the lance driving system 38 through the signal processing control section 35 to insert the lance into the coke oven and to make the lance scan the oven wall to be repaired. The condition of the oven wall is picked up by the CCD camera 23 at the top end of the lance to obtain the image of the oven wall. The image thus picked up is displayed on the repair monitor 34. The repair monitor 34 displays the wearing status image along the X and the Y axes in the coordinate corresponding to the travelling distances of the repairing material spraying position at the top end of the lance along the X, the Y, and the Z axes with respect to the reference point (0, 0, 0) on the X, the Y, and the Z axes.

The movement of the lance is performed by the lance driving system 38 under control of the signal processing control section 35 in the manner similar to the above-described embodiment. The driving amount information of each drive portion is supplied from the lance driving system 38 to the signal processing control section 35. The absolute position of the repairing material spraying position is calculated from the driving amount information with respect to the reference point (0, 0, 0) on the X, the Y, and the Z axes as a start point and is corrected by estimation of the flexure $\epsilon$ of the top end of the lance.

Subsequently, the signal processing control section 35 carries out image processing of the driving amount information supplied from the lance driving system 38, the wear amount data of the oven wall supplied from the laser range finder 25, and the position coordinate data of the depression in the oven wall resulting from wear. The signal processing control section classifies each portion of the oven wall by the level of wear, namely, the depth of the depression to make the wear distribution chart as illustrated in FIG. 19 be displayed on the repair monitor 34.

With reference to the observation data of the wear distribution chart as displayed, the display on the monitor, and the temperature of the wall surface at the worn area as detected by the radiation thermometer 24, the operator confirms the shape and the range of the damage and, in dependence upon the shape and the range of the damage at a site to be repaired, carries out selection and combination of the basic motion patterns and the travelling patterns illustrated in FIGS. 22 and 23. The operator supplies the lance driving system 38 with indication of the required repair range within the oven wall surface and a selected one of the predetermined repair patterns.

The signal processing control section 35 is responsive to the indicated repair range and the selected one of the predetermined repair patterns and delivers the control signal to the lance driving system 38 to control the travelling speed of the repairing nozzle 14-1 and/or the amount of the repairing material to be injected. Thus, automatic repair is carried out by the multistage telescopic lance unit.

Figure 24:
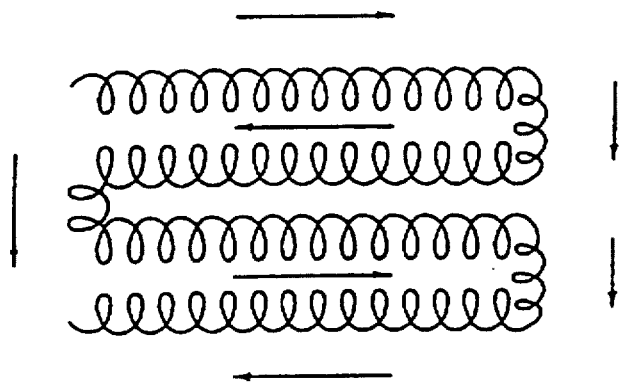
FIG. 24 shows a travelling pattern of the injection nozzle in case where the oven wall is repaired by the second method according to this invention.

FIG. 24 shows an example of the selected repair pattern in case where the oven wall is repaired by flame spraying in accordance with the above-mentioned method. In this case, the repair range is relatively as large as about 1 $m^2$. In this connection, the circular motion pattern illustrated in FIG. 22(*c*) is selected as the basic motion pattern for the repairing nozzle 14-1. On the other hand, a combination of the horizontal movement pattern and the vertical movement pattern illustrated in FIG. 23(*a*) is selected as the travelling pattern. In accordance with the selected travelling pattern, the signal processing control section 35 controls the lance driving system 38 to position the repairing nozzle 14-1 at an upper left corner of the damaged area. The repairing nozzle 14-1 individually repeats the circular motion at that position. Then, the center of the circular motion is moved leftward, rightward, upward, and downward in accordance with the selected travelling pattern.

The diameter and the rotation speed of the circular motion are different in dependence upon a flame spraying method, characteristics of a mechanical device, and so on. In this embodiment, it is assumed that the diameter is equal to 50 mmϕ and the rotation speed is equal to 20 mm/sec. The travelling speed of the center of the circular motion is preferably equal to the rotation speed. As to the travelling direction, it is desirable that the horizontal direction is given priority. After the center of the circular motion is moved in the horizontal direction for a predetermined distance (about 70 cm in this embodiment), the center is moved downwards (moved down by about 40 mm in this embodiment) so that successive circular motions are partially overlapped with each other. Again, movement in the horizontal direction is carried out. The above-mentioned operation is repeated to automatically repair the front surface of the damaged area.

Figure 25A:
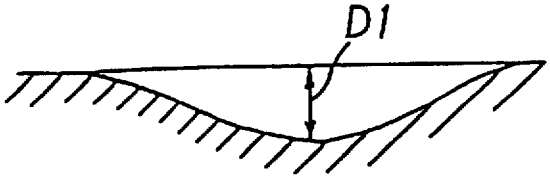
FIGS. 25(*a*)–25(*c*) show a relationship of a wear condition of the oven wall, a travelling pattern of the injection nozzle, and a travelling speed of the injection nozzle.
Figure 25B:
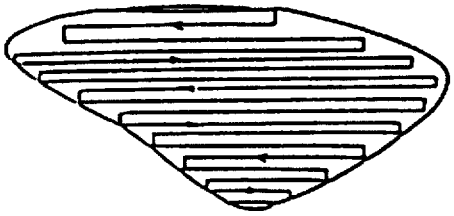
Figure 25C:
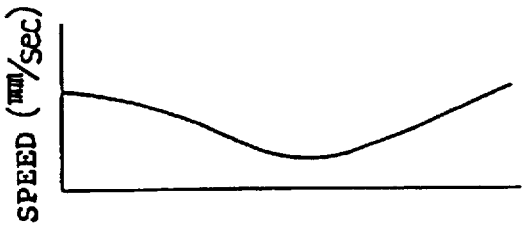

Referring to FIGS. 25(*a*)–25(*c*), description will be made as regards an operation in case where the damaged area having a relatively shallow damage is repaired by a single flame spraying operation. In correspondence to a damage depth D1 illustrated in FIG. 25(*a*), the travelling speed of the repairing nozzle 14-1 is varied as illustrated in FIG. 25(*c*) to control a spraying thickness. In this manner, the damaged area can be repaired by the single flame spraying operation. As regards the travelling pattern, the travelling pattern illustrated in FIG. 23(*a*) is selected for the range illustrated in FIG. 25(*b*).

Figure 26A:
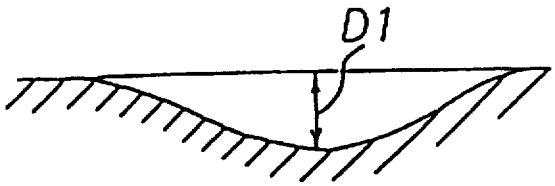
FIGS. 26(*a*)–26(*c*) show a relationship of the wear condition of the oven wall, the travelling pattern of the injection nozzle, and an amount of the spraying material to be sprayed.
Figure 26B:
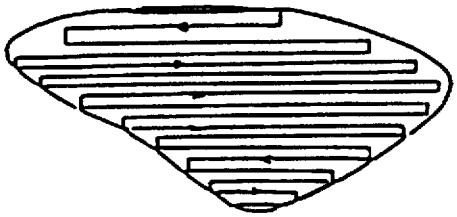
Figure 26C:
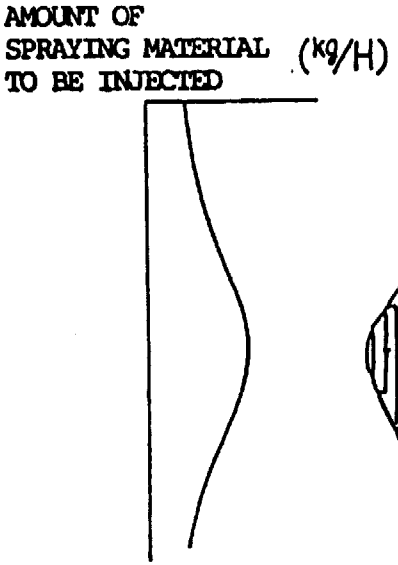

Referring to FIGS. 26(*a*)–26(*c*), description will be made as regards another operation in case where the damaged area having a relatively shallow damage is repaired by a single flame spraying operation. In correspondence to the damage depth D1 illustrated in FIG. 26(*a*), the amount of the spraying material to be injected from the repairing nozzle 14-1 is varied as illustrated in FIG. 26(*c*) to control the spraying thickness. In this manner, the damaged area can be repaired by the single flame spraying operation. As regards the travelling pattern, the travelling pattern similar to that illustrated in FIG. 25(*b*) is selected.

Figure 27A:
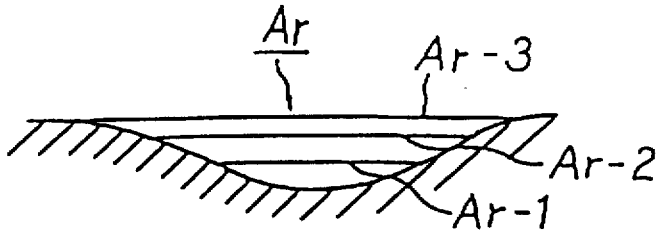
FIGS. 27(*a*)–27(*c*) are a view for describing a method of repairing a deep repair part from a deeper level to a shallow level.
Figure 27B:
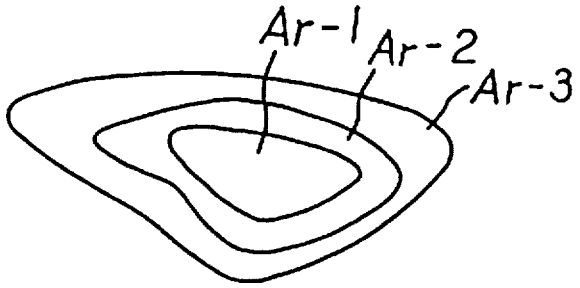
Figure 27C:
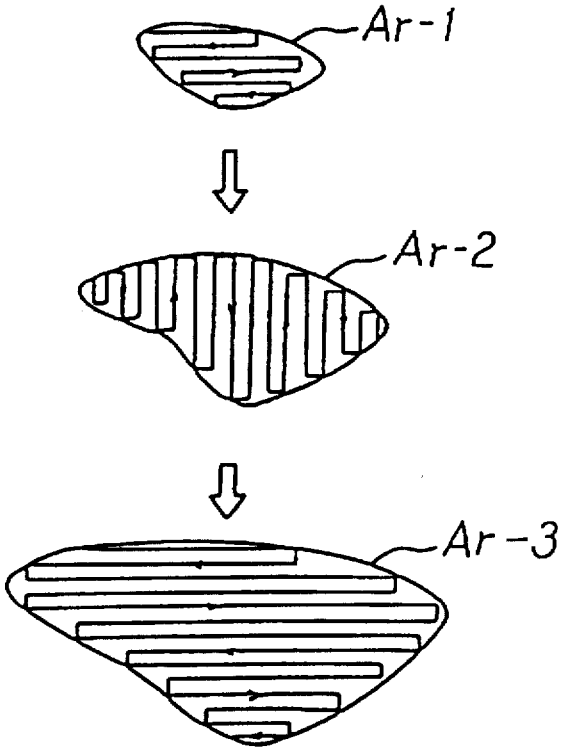

Referring to FIGS. 27(*a*)–27(*c*), description will be made as regards an operation in case where a deep damaged area is repaired in the order from a deepest level to a shallow level. As illustrated in FIGS. 27(*a*) and (*b*), a repair range Ar is divided into a plurality of segments along the depth of the damage. Herein, it is divided into first through third segments Ar-1 through Ar-3. In this case, as illustrated in FIG. 27(*c*), the first through the third segments Ar-1, Ar-2, and Ar-3 are repaired in this order from the deepest level. The repair range is varied at each of the first through the third segments Ar-1, Ar-2, and Ar-3. In this repair pattern, a surface plane is contoured at each stage of repair. It is therefore possible to prevent plethoric deposition of the repairing material and to smooth a boundary to a brick surface free from damage. Such a plethoric deposition can readily be prevented by monitoring the distance to the repair surface by the use of the laser range finder 25.

Figure 28:
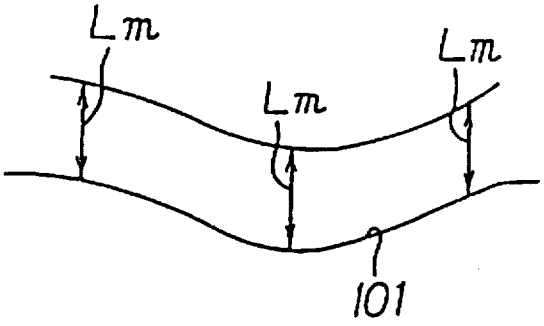
FIG. 28 is a view for describing a method of keeping a distance between the injection nozzle and the oven wall surface constant in correspondence to the depth of a worn or a damaged area.

In the above-mentioned automatic repair of the damaged area, it is important to keep a distance Lm between the oven wall 101 and the repairing nozzle 14-1 and the temperature of the oven wall 101 constant in order to improve adhesive strength of the spraying material and durability of the spraying material. For this purpose, the signal processing control section 35 is successively supplied from the laser range finder 25 with the distance Lm between the repairing nozzle 14-1 and the wall surface, as illustrated in FIG. 28, and controls the lance driving system 38 to control the lance extension length and the swinging angle $R_Y$. Through such control, the distance Lm between the repairing nozzle 14-1 and the oven wall 101 is kept constant. In response to the temperature of the oven wall 101 successively supplied from the radiation thermometer 24, the signal processing control section 35 controls the travelling speed of the repairing nozzle 14-1 and/or the amount of the spraying material to be injected so as to keep the temperature of the repair surface constant.

Figure 29:
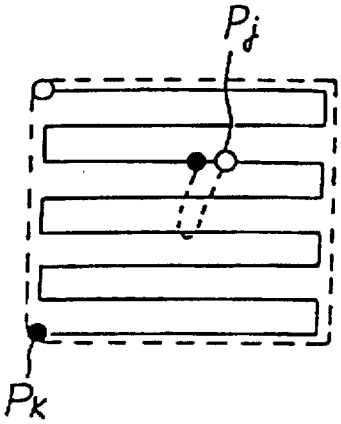
FIG. 29 is a view for describing an operation of restarting automatic repair which has temporarily been interrupted in the middle of the repair work according to a selected repair pattern.

It is assumed that, during execution of automatic repair in accordance with the repair pattern as selected, temporary interruption of the automatic repair and temporary retreat of the lance carriage 1 are required due to interference with a pushing machine of the coke oven or a coke guide car. In this event, the following operation is carried out. The multistage telescopic lance unit is shortened to move the repairing nozzle 14-1 as desired. Thereafter, the lance carriage 1 is temporarily retreated. At the time instant when the interference with the pushing machine or the coke guide car is released, the lance carriage 1 is again located at a former position before retreat. Then, as illustrated in FIG. 29, the multistage telescopic lance unit is extended and the repairing nozzle 14-1 is located at a position Pj at the time of interruption. The automatic repair is continued from the position at the time of interruption until a completion position Pk is reached.

Turning back to FIG. 21, the lance is inserted substantially in parallel to the oven wall 101. The laser range finder 25 measures distances $Z_{T1}$ and $Z_{T2}$ from the oven wall surface 101 at given positions $P_1$ and $P_2$ in normal brick areas between which the damaged area is interposed. The distances are memorized in the memory of the signal processing control section 35. In order to keep an appropriate distance between the oven wall 101 and the repairing nozzle 14-1 during repair by flame spraying, a distance $Z_1$ between the measurement position and an approaching position nearer to the oven wall 101 is continuously calculated from the length from a swinging center of the lance to the repairing nozzle 14-1 and the travelling speed. When the distance $Z_1$ in a zone between the positions $P_1$ and $P_2$ and a measured distance Z2 has a relationship $Z_1+Z_2 \leqq Z_{T1}$ (or $Z_{T2}$), an alarm is produced. Thus, it is possible to warn the operator against plethoric deposition.

In the foregoing embodiments, description has been directed to the cases where the repair pattern as illustrated in FIG. 24 is selected which is a combination of the basic motion pattern and the travelling pattern. However, it is possible, by the use of one of the basic motion pattern and the travelling pattern alone, to repair the oven wall in a dotted fashion or in a linear fashion to the depth of the worn area as detected by the laser range finder. Accordingly, it is possible to repair one point alone by the use of the repairing method according to this invention. Description has been made as regards the case where the wear distribution chart of the worn area is prepared by the use of the image pickup device and the monitor and through image processing of the image information of the wall surface. However, it is also possible to prepare the wear distribution chart of the worn area by the use of the position coordinate data of the worn area and the wear amount data measured by the laser range finder alone. Furthermore, it is possible to select and determine the basic motion pattern and/or the travelling pattern in accordance with the wear distribution chart thus obtained.

Description has been made as regards the case where either the travelling speed of the repairing nozzle or the amount of the repairing material to be sprayed (namely, the amount to be injected) is controlled during repair. However, the worn area may be repaired by controlling both the travelling speed of the repairing nozzle and the amount of the repairing material to be sprayed. Description has been made as regards the case where the laser range finder continuously monitors, while the oven wall is repaired, that the repair surface varying from time to time exceeds the virtual line of the normal oven wall surface. However, it is also possible, by watching the amount of the repairing material to be sprayed or the repair time, to monitor that the repair surface exceeds the virtual line of the normal oven wall surface. Furthermore, when it is detected that the repair surface exceeds the virtual line of the normal oven wall surface, not only the alarm but also an instruction to stop the injection of the repairing material are produced so that the injection of the repairing material is stopped.

In the foregoing embodiments, the laser range finder is used as the distance sensor. However, it will readily be understood that an ultrasonic sensor may be used. Description has been made as regards the case where the image pickup device comprises a single CCD camera mounted on the lance head portion. However, a plurality of the CCD cameras can be mounted on the lance head portion to obtain a three-dimensional image. It is possible to prepare the wear distribution chart from the three-dimensional image or to determine the repair range with reference to the three-dimensional image.

Description has been made on the assumption that the repairing apparatus is movable up and down along the Y axis. However, inasmuch as the repairing apparatus can be rotated and tilted around the Z axis as illustrated in the figure, up-and-down movement along the Y axis is not essential. At any rate, it is sufficient that the oven wall repairing apparatus according to this invention has a lance capable of moving in a linear fashion or along a plane on the oven wall surface.

EFFECT OF THE INVENTION

With the oven wall repairing apparatus according to this invention, it is easy to control the position of the repairing nozzle. It is possible to carry out observation, measurement, and repair over a wide range within the oven simply by rearrangement of the lance head portion. Therefore, a repair work time is remarkably reduced. With the oven wall repairing method according to this invention, repair work is carried out by selecting the repair range and the repair pattern based on quantitative detection of the wear condition and by automatically operating the repairing lance. In addition, a smoothness is improved on the boundary with the normal brick surface and on the repaired surface. Plethoric deposition is prevented to suppress an increase of push-out resistance when the coke is pushed out. In addition, the durability of a repaired area is improved.

INDUSTRIAL APPLICABILITY

As described above, the method and the apparatus for repairing a coke oven according to this invention is capable of remarkably extending the lifetime of the coke oven by repairing the oven wall of the coke oven.

We claim:

1. A coke oven repairing method for repairing an oven wall of a coke oven by the use of a lance, said method comprising the steps of arranging a distance sensor at a top end of said lance, successively measuring a depth of a damaged area in an oven wall surface by successively scanning the oven wall surface by a beam emitted from said distance sensor, determining an amount of a repairing material with reference to a measurement result obtained by said distance sensor, and injecting the amount of the repairing material from a repairing nozzle to said damaged area to thereby repair said damaged area.

2. A coke oven repairing method as claimed in claim 1, further comprising the steps of moving said distance sensor along said oven wall surface to obtain position coordinate data of said worn area, and repairing said worn area with reference to said position coordinate data and the depth of said worn area.

3. A coke oven repairing method as claimed in claim 2, further comprising the steps of determining a repair range on said oven wall surface with reference to the measurement result obtained by said distance sensor and said position coordinate data, and moving said repairing nozzle within said repair range as determined to thereby repair said worn area.

4. A coke oven repairing method as claimed in claim 3, further comprising the steps of preparing a plurality of repair patterns, selecting, as a selected repair pattern, a particular one in correspondence to said repair range as determined, and moving said repairing nozzle within said repair range in accordance with said selected repair pattern to thereby repair said worn area.

5. A coke oven repairing method as claimed in claim 3, further comprising the steps of preparing a plurality of basic motion patterns, and moving said repairing nozzle within said repair range in accordance with any one of said basic motion patterns to thereby repair said worn area.

6. A coke oven repairing method as claimed in claim 3, further comprising the steps of preparing a plurality of travelling patterns, and moving said repairing nozzle within said repair range in accordance with any one of said travelling patterns to thereby repair said worn area.

7. A coke oven repairing method as claimed in claim 3, further comprising the steps of preliminarily setting a plurality of travelling patterns of said lance in correspondence to said repair range, and moving said repairing nozzle within said repair range in accordance with a combination of each travelling pattern and basic motion patterns to thereby repair said worn area.

8. A coke oven repairing method as claimed in any one of claims 1 through 7, further comprising the steps of preparing a wear distribution chart of said worn area by the use of said distance sensor, and repairing said worn area in accordance with said wear distribution chart.

9. A coke oven repairing method as claimed in claim 8, further comprising the step of controlling a travelling speed of said repairing nozzle and/or an amount of said repairing material to be injected to thereby repair said worn area.

10. A coke oven repairing method as claimed in any one of claims 1 through 7, further comprising the step of controlling a travelling speed of said repairing nozzle and/or an amount of said repairing material to be injected to thereby repair said worn area.

11. A coke oven repairing method as claimed in claim 1, further comprising the step of monitoring, with reference to the measurement result of said distance sensor, that a repair surface varying from time to time exceeds a virtual line of a normal oven wall surface.

12. A coke oven repairing method as claimed in claim 11, further comprising the step of producing an alarm and/or an instruction to stop injection of said repairing material when said repair surface exceeds the virtual line of said normal oven wall surface.

13. A coke oven repairing method as claimed in claim 12, further comprising the step of monitoring an amount of said repairing material to be injected and/or a repair time to thereby detect that said repair surface exceeds the virtual line of said normal oven wall surface.

14. A coke oven repairing method as claimed in claim 1, further comprising the steps of setting a distance to a normal oven wall surface surrounding said worn area by the use of said distance sensor, measuring a distance between said distance sensor and a repair surface varying from time to time during repair, and monitoring that said repair surface varying from time to time exceeds the virtual line of said normal oven wall surface at said worn area.

15. A coke oven repairing method as claimed in claim 14, further comprising the step of producing an alarm and/or an instruction to stop injection of said repairing material when said repair surface exceeds the virtual line of said normal oven wall surface.

16. A coke oven repairing method as claimed in claim 15, further comprising the step of watching an amount of said repairing material to be injected and/or a repair time to thereby detect that said repair surface exceeds the virtual line of said normal oven wall surface.

17. A coke oven repairing method for repairing an oven wall of a coke oven by the use of a repairing apparatus capable of controlling a position of a repairing nozzle, comprising the steps of preliminarily setting, in a lance control section, basic motion patterns for said repairing nozzle and traveling patterns within a repair range, detecting wear information of a damaged area by scanning the damaged area of the oven wall by a distance detecting beam, determining said repair range prior to start of repair with reference to the wear information of the damaged area, selecting a repair pattern for the damaged area comprising a combination of one of said basic motion patterns for said repairing nozzle and one of said traveling patterns, and controlling at least one of a traveling speed of said repairing nozzle and an amount of a repairing material to be injected to thereby repair said damaged area.

18. A coke oven repairing method as claimed in claim 17, further comprising the steps of specifying said repair range with reference to image information of said worn area, and obtaining wear information of said repair range as specified.

19. A coke oven repairing method as claimed in claim 17, further comprising the steps of preparing a wear distribution chart with reference to wear information of said worn area to determine said repair range, selecting the repair pattern comprising a combination of one of said basic motion patterns for said repairing nozzle and one of said travelling patterns, and controlling the travelling speed of said repairing nozzle and/or the amount of said repairing material to be injected to thereby repair said worn area.

20. A coke oven repairing method as claimed in any one of claims 17 through 19, further comprising the step of monitoring that a repair surface varying from time to time exceeds a virtual line of a normal oven wall surface.

21. A coke oven repairing method as claimed in claim 20, further comprising the step of producing an alarm and/or an instruction to stop injection of said repairing material when said repair surface varying from time to time exceeds the virtual line of said normal oven wall surface.

22. A coke oven repairing method as claimed in claim 20, a distance sensor being used to monitor that said repair surface exceeds the virtual line of said normal oven wall surface.

23. A coke oven repairing method comprising the steps of scanning an oven wall surface by the use of an image pickup device mounted at a top end of a lance having a repairing nozzle for injecting a repairing material, displaying an image on a monitor, successively scanning said oven wall surface while measuring a distance between the top end of said lance and said oven wall surface by a distance sensor mounted at the top end of said lance to obtain wear amount data of said oven wall surface including location, size and depth of a damaged area, calculating, from a driving amount of a lance driving mechanism for driving said lance, position coordinate data of the damaged area in said oven wall surface with respect to the top end of said lance, determining amount of repairing material for a required repair range on said oven wall surface and selecting a repair pattern for movement of said lance over the damaged area with reference to image information of said wall surface, said wear amount data, and said position coordinate data of said worn area, and repairing said worn area in said oven wall surface by spraying in accordance with the repair pattern selected.

24. A coke oven repairing apparatus comprising a multistage telescopic lance unit provided at its top end with a repairing nozzle which is for injecting a repairing material and which is movable, a lance driving means for driving said multistage telescopic lance unit, a distance sensor mounted at the top end of said multistage telescopic lance unit for measuring distance from an oven wall surface, and a lance operating means for calculating wear amount data of said oven wall surface in response to a signal supplied from said distance sensor and for operating said lance unit with reference to said wear amount data and position coordinate data of a worn or a damaged area so that said nozzle is moved over said worn area in said oven wall surface, said lance operating means comprising signal processing control means for calculating, from a driving amount of said lance driving mechanism, position coordinate data of said worn or damaged area in said oven wall surface with respect to the top end of said lance and for determining location, size and depth of the damaged area on said oven wall surface and selecting a repair pattern with reference to said position coordinate data of said worn or damaged area and said wear amount data, said lance operating means being responsive to instructions from said signal processing control means for operating said lance so that said repairing nozzle is moved along said repair pattern over said worn or damaged area in said oven wall surface while controlling at least one of a traveling speed for said repairing nozzle and an amount of repairing material to be injected onto said worn or damaged area.

25. A coke oven repairing apparatus as claimed in claim 24, said repairing apparatus further comprising an image pickup device mounted at the top end of said lance for picking up an image of said oven wall surface, and a monitor for displaying said image of said oven wall surface picked up by said image pickup device.

26. A coke oven repairing apparatus as claimed in any one of claims 24 and 25, said multistage telescopic lance unit being movable along a plane (two-dimensionally), on a predefined X-Y-Z coordinate system, along at least two axes with respect to said oven wall surface.

27. A coke oven repairing apparatus as claimed in any one of claims 24 and 25, said multistage telescopic lance unit being extendable, movable, and rotatable and tiltable around a Z axis.

28. A coke oven repairing apparatus as claimed in claim 26, said multistage telescopic lance unit being rotatable around a lance axis and a Y axis.

29. A coke oven repairing apparatus using a multistage telescopic lance unit, wherein said multistage telescopic lance unit has an axis extendable in a predetermined direction and a lance driving system for driving said multistage telescopic lance unit, said multistage telescopic lance unit comprising a first-stage lance, second-stage through N-th-stage lances assembled in said first-stage lance to be extendable in an axial direction, and a fixed outer cylinder for fitting and accommodating said first-stage lance therein to thereby support said first-stage through said N-th-stage lances, said lance driving system comprising a lance extension driving mechanism formed between said fixed outer cylinder and said first-stage through said N-th stage lances, and a tilting mechanism for tilting said fixed outer cylinder in a vertical plane.

30. A coke oven repairing apparatus as claimed in claim 29, said lance extension driving mechanism comprising a rack fixed to an outer surface of said first-stage lance, a pinion formed on said fixed outer cylinder, a forward movement mechanism for moving said second-stage through said N-th-stage lances in cooperation with a forward movement of said first-stage lance by said rack and said pinion, and a backward movement mechanism for moving said second-stage through said N-th-stage lances in cooperation with a backward movement of said first-stage lance.

31. A coke oven repairing apparatus as claimed in claim 29 or 30, each of said first-stage through said N-th stage lances having a cooling jacket structure formed by multiple cylindrical members having partitioning portions extending in a longitudinal direction with a cooling medium flowing therebetween.

32. A coke oven repairing apparatus as claimed in claim 29 or 30, said multistage telescopic lance unit comprising a cylindrical member having a polygonal cross section.

33. A coke oven repairing apparatus as claimed in claim 32, each of said first-stage through said N-th-stage lances having a cooling jacket structure formed by multiple cylindrical members having partitioning portions extending in a longitudinal direction with a cooling medium flowing therebetween.

34. A coke oven repairing apparatus as claimed in claim 29, said N-th stage lance having both a cooling jacket structure formed by multiple cylindrical members having partitioning portions extending in a longitudinal direction with a cooling medium flowing therebetween and a structure such that said cooling medium in an inner cylindrical member is injected from a portion around a transparent window formed at the top end thereof.

35. A coke oven repairing apparatus as claimed in claim 29, said lance driving system further comprising a swinging mechanism for swinging said fixed outer cylinder in a horizontal plane and a rotating mechanism for rotating said fixed outer cylinder around a lance axis.

36. A coke oven repairing apparatus as claimed in claim 29, said N-th-stage lance being provided at its top end with a nozzle for injecting a repairing material and a distance sensor for measuring a distance to said oven wall surface.

* * * * *